US011168481B2

(12) United States Patent
Rieber

(10) Patent No.: US 11,168,481 B2
(45) Date of Patent: Nov. 9, 2021

(54) LOUVER SYSTEM AND METHOD OF ASSEMBLING SAME

(71) Applicant: Yardistry Limited, Waterloo (CA)

(72) Inventor: Frederick Rieber, Hamburg, NY (US)

(73) Assignee: YARDISTRY US, LLC, Ann Arbor, MI (US)

( * ) Notice: Subject to any disclaimer, the term of this patent is extended or adjusted under 35 U.S.C. 154(b) by 0 days.

(21) Appl. No.: 17/137,793

(22) Filed: Dec. 30, 2020

(65) Prior Publication Data

US 2021/0198896 A1 Jul. 1, 2021

Related U.S. Application Data

(60) Provisional application No. 62/955,110, filed on Dec. 30, 2019.

(51) Int. Cl.
*E04F 10/10* (2006.01)

(52) U.S. Cl.
CPC ..... *E04F 10/10* (2013.01)

(58) Field of Classification Search
CPC ..... E04F 10/10; E04F 10/08; E04D 13/15; E04D 13/0351; E04H 4/08; E04H 4/0043; E04B 7/163; E04B 9/386
See application file for complete search history.

(56) References Cited

U.S. PATENT DOCUMENTS 4,099,346 A * 7/1978 Isono ..... E04B 7/163 160/236
4,527,355 A 7/1985 Numakami et al.
4,926,599 A * 5/1990 Scholz ..... E04F 10/10 49/87.1
5,775,399 A * 7/1998 Shields, Jr. ..... E06B 9/386 160/176.1 R
5,862,633 A * 1/1999 Van Ells ..... F24F 5/00 52/16
5,873,202 A * 2/1999 Parks ..... E04F 10/10 52/73
5,941,021 A * 8/1999 Valls, Jr. ..... E06B 7/086 49/92.1
8,756,873 B1 * 6/2014 Hire ..... E04F 10/10 52/72
9,422,715 B1 * 8/2016 Selzer ..... E04D 11/00
9,650,786 B2 5/2017 Waver et al.
9,903,114 B2 * 2/2018 Partridge ..... E04B 1/82
(Continued)

*Primary Examiner* — Beth A Stephan

(74) *Attorney, Agent, or Firm* — Shumaker, Loop & Kendrick, LLP; Jeffrey B. Fabian

(57) ABSTRACT

A louver system including a louver assembly mounted to a frame. The louver assembly includes first and second side members mounted to respective side elements of the frame, and a number of slat subassemblies with respective slat bodies that are rotatable about respective axes of rotation thereof. The slat bodies are rotatably held between the first and second side members by pivot pins. The pivot pins include one or more extended pivot pins, for securing the louver assembly to the side elements of the frame. Each extended pivot pin extends between inner and outer ends thereof. The outer end is formed to be partially positioned in a selected one of the side elements, and to engage an outer side of the selected side element. The inner end is formed for location in a selected one of the slat bodies, to rotatably secure the selected slat body between the side elements.

14 Claims, 29 Drawing Sheets

(56) References Cited

U.S. PATENT DOCUMENTS

| | | | | |
|---|---|---|---|---|
| 10,094,122 | B1 * | 10/2018 | Akbulut | E04F 10/10 |
| 10,214,938 | B2 * | 2/2019 | Pan | E04H 15/58 |
| 10,858,840 | B2 * | 12/2020 | Ji | E06B 7/086 |
| 10,988,926 | B2 * | 4/2021 | Mitchell | E04F 10/10 |
| 11,015,349 | B2 * | 5/2021 | Byszenski | E06B 7/092 |
| 11,060,296 | B2 * | 7/2021 | Castel | E04F 10/10 |
| 2004/0148899 | A1 | 8/2004 | Pertile | |
| 2006/0272214 | A1 | 12/2006 | Simonelli et al. | |
| 2011/0225913 | A1 | 9/2011 | Frigerio | |
| 2013/0291438 | A1 * | 11/2013 | Selzer | E04B 7/163 49/82.1 |
| 2014/0130988 | A1 | 5/2014 | Frigerio | |
| 2014/0175240 | A1 * | 6/2014 | Selzer | E04F 10/10 248/237 |
| 2016/0177575 | A1 * | 6/2016 | Ivic | E06B 9/386 52/302.1 |
| 2018/0202155 | A1 * | 7/2018 | Abeel | E04B 1/343 |
| 2018/0320374 | A1 * | 11/2018 | Castel | E04F 10/08 |
| 2019/0338528 | A1 * | 11/2019 | Torman | E04F 10/10 |
| 2020/0370299 | A1 * | 11/2020 | Shan | E04F 10/10 |
| 2021/0010270 | A1 * | 1/2021 | Zhao | E04F 10/10 |
| 2021/0062505 | A1 * | 3/2021 | Elmore | E04F 10/10 |
| 2021/0262237 | A1 * | 8/2021 | Vanthournout | E04B 7/166 |
| 2021/0277660 | A1 * | 9/2021 | Zveibil | E04F 10/10 |

* cited by examiner

LOUVER SYSTEM AND METHOD OF ASSEMBLING SAME

CROSS-REFERENCE TO RELATED APPLICATION

This application claims the benefit of U.S. Provisional Patent Application No. 62/955,110, filed on Dec. 30, 2019, the entirety of which is hereby incorporated herein by reference.

FIELD OF THE INVENTION

The present invention is a louver system including a louver assembly mounted in a frame.

BACKGROUND OF THE INVENTION

Various systems of movable slats, or louvers, are known in the art. However, the known systems of louvers tend to be complex and are designed to be supported in a relatively strong frame, which may be relatively expensive.

SUMMARY OF THE INVENTION

For the foregoing reasons, there is a need for a louver system that overcomes or mitigates one or more of the defects or disadvantages of the prior art.

In its broad aspect, the invention provides a louver system including a louver assembly attached to a frame. The louver assembly includes first and second side members mounted to respective side elements of the frame, and a number of slat subassemblies with respective slat bodies that are rotatable about respective axes of rotation thereof. The slat bodies are rotatably held between the first and second side members by pivot pins.

The pivot pins include one or more extended pivot pins, for securing the louver assembly to the side elements of the frame. Each extended pivot pin extends between inner and outer ends thereof. The outer end is formed to be partially positioned in a selected one of the side elements, and to engage an outer side of the selected one of the side elements. The inner end is formed for location in a selected one of the slat bodies, to rotatably secure the selected one of the slat bodies between the first and second side elements.

In one of its aspects, the extended pivot pins include a first extended pivot pin and a second extended pivot pin. The first and second extended pivot pins are partially located in the first and second side elements respectively. The first and second extended pivot pins include head portions thereof at their respective outer ends. The head portions of the first and second pivot pins engage the outer sides of the first and second side elements respectively, and the inner ends of the first and second extended pivot pins are respectively secured in first and second ends of the selected one of the slat bodies. The first and second extended pivot pins rotatably secure the selected one of the slat bodies between the first and second side elements respectively, to at least partially secure the louver assembly between the first and second side elements.

BRIEF DESCRIPTION OF THE DRAWINGS

The invention will be better understood with reference to the attached drawings, in which.

DETAILED DESCRIPTION

Figure 1A:
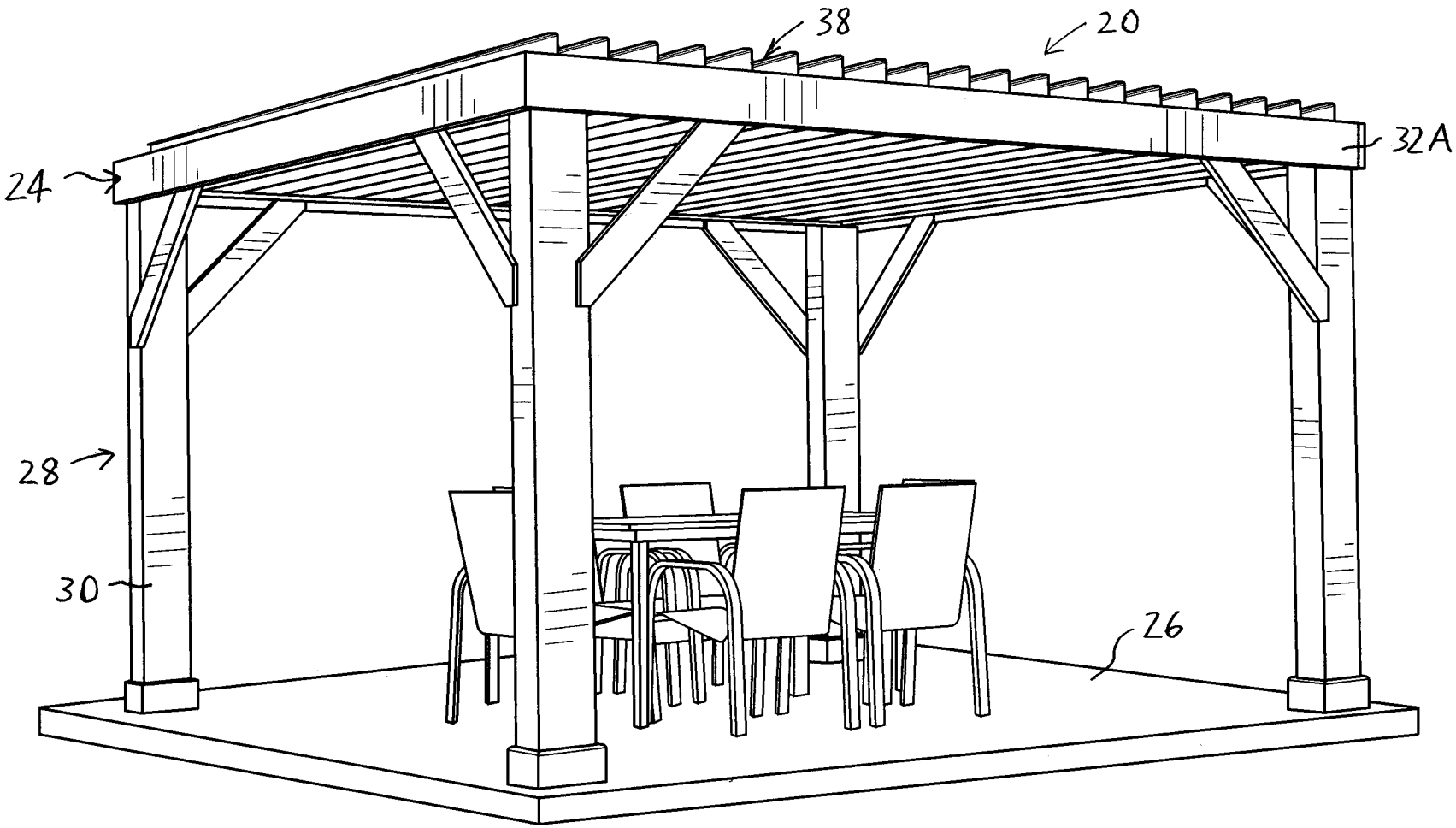
FIG. 1A is an isometric view of an embodiment of a louver system of the invention, including a louver assembly with a number of parallel slat subassemblies mounted in a frame assembly, the louver assembly being in an open condition thereof.

In the attached drawings, like reference numerals designate corresponding elements throughout. Reference is first made to FIGS. 1A-1C, 2A-6, and 8A-9B to describe an embodiment of a louver system in accordance with the invention indicated generally by the numeral 20. As will be described, the louver system 20 is for alternately covering and uncovering an aperture 22 in a frame 24 (FIG. 1C) located above a surface 26 (FIG. 1A).

Figure 1B:
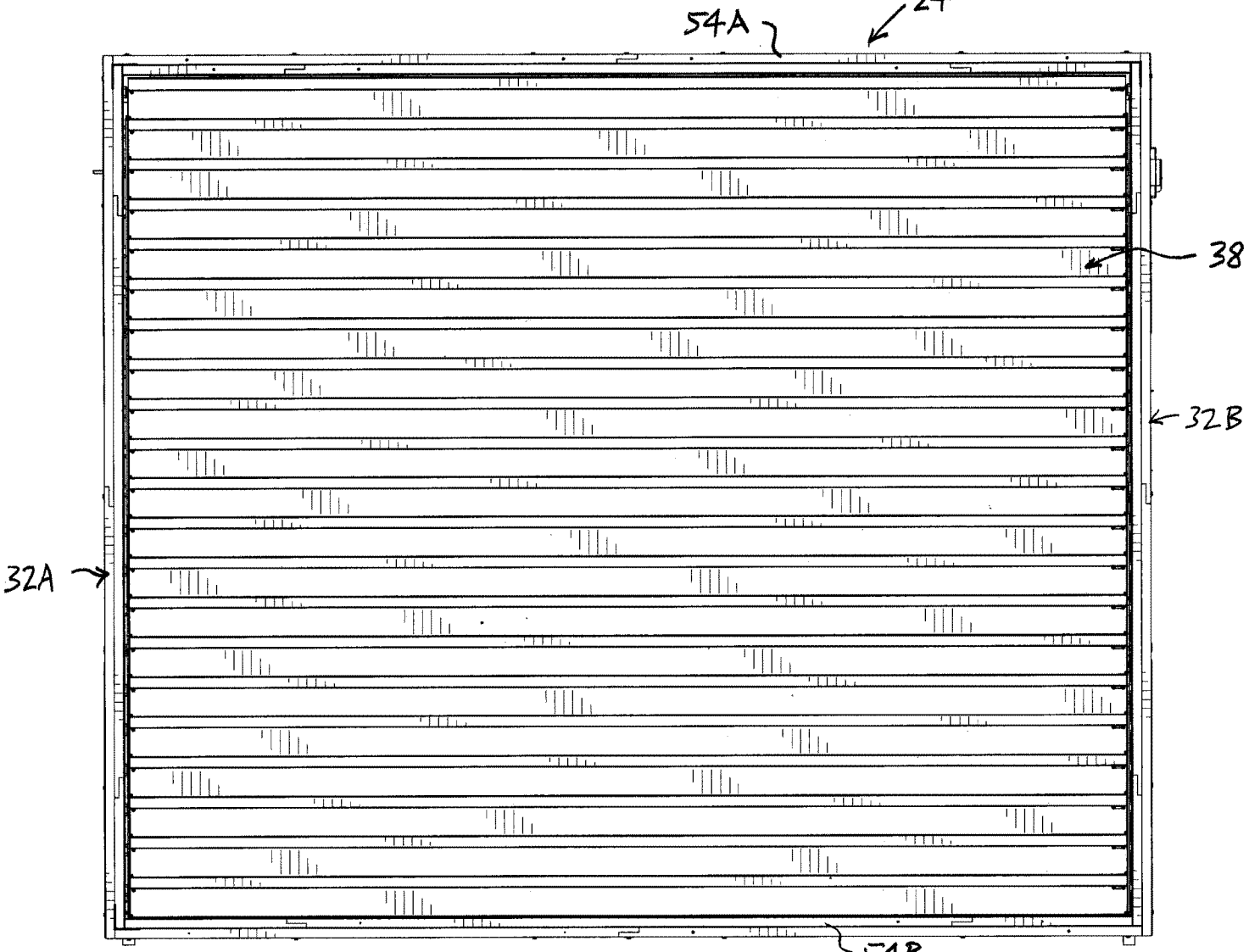
FIG. 1B is a top view of the system of FIG. 1A in which the louver assembly is in a closed condition, drawn at a larger scale.
Figure 1C:
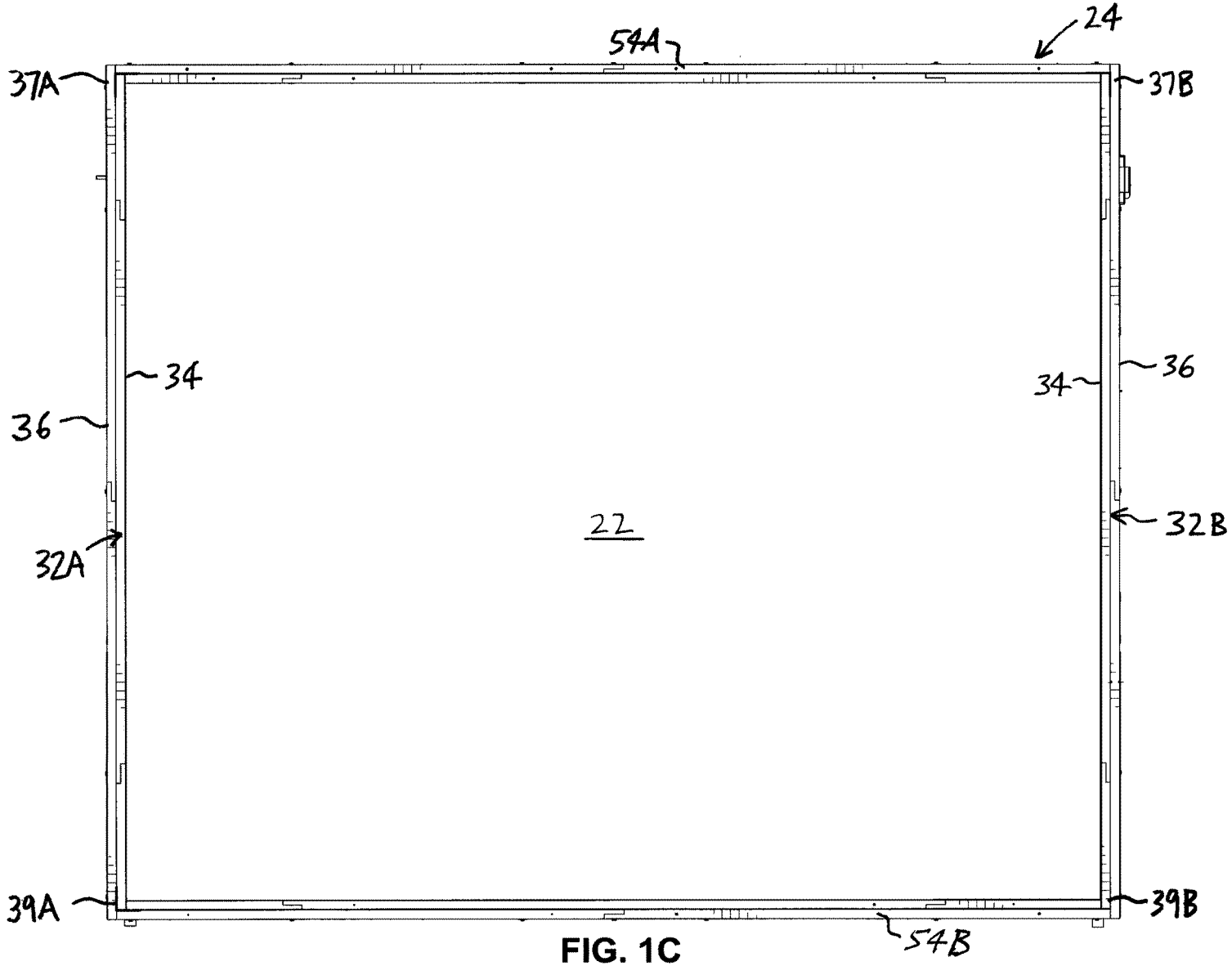
FIG. 1C is a top view of the frame assembly of FIG. 1A.

In one embodiment, the louver system 20 preferably includes a frame assembly 28 that includes the frame 24, and one or more support elements 30 supporting the frame 24 in a preselected position relative to the surface 26. As can be seen in FIGS. 1B and 1C, the frame 24 preferably includes first and second side elements 32A, 32B spaced apart from each other to at least partially define the aperture 22. Each of the side elements 32A, 32B has opposed inner and outer sides 34, 36 thereof (FIG. 1C). The inner sides 34 of the side elements 32A, 32B partially define the aperture 22. It is also preferred that the louver system 20 includes one or more louver assemblies 38, mounted to the frame 24 (FIGS. 1B, 2A).

Figure 2A:
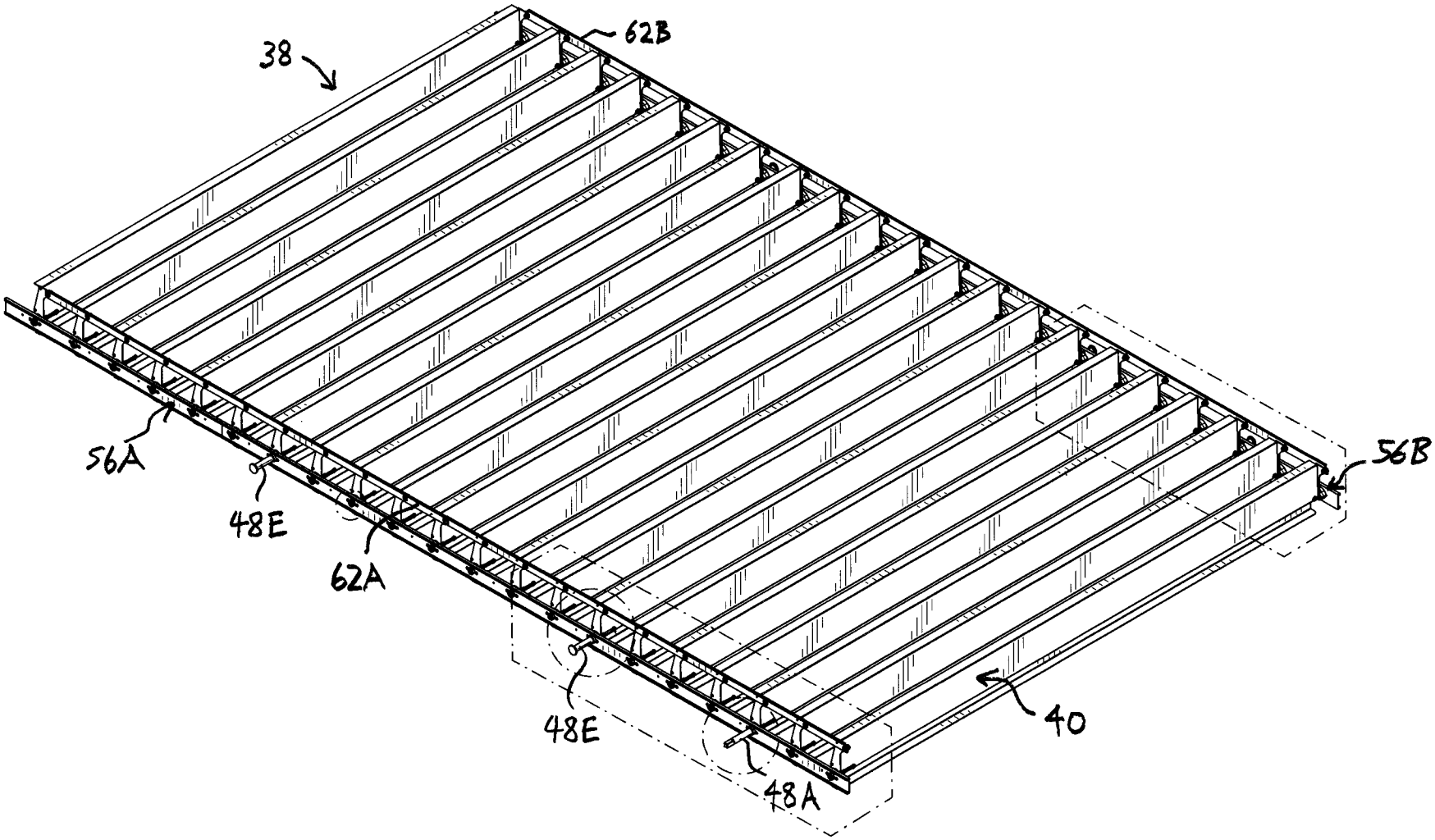
FIG. 2A is an isometric view of the louver assembly of the louver system of FIG. 1A including a number of slat subassemblies pivotably mounted to side members, drawn at a larger scale.
Figure 2D:
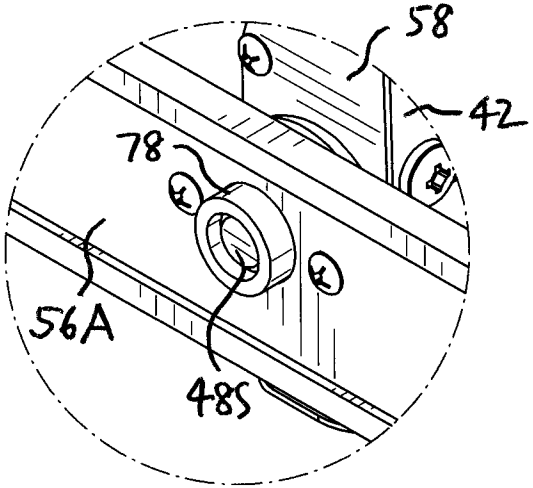
FIG. 2D is an isometric view of a standard pivot pin of the louver assembly of FIG. 2A extending from a side member.
Figure 2C:
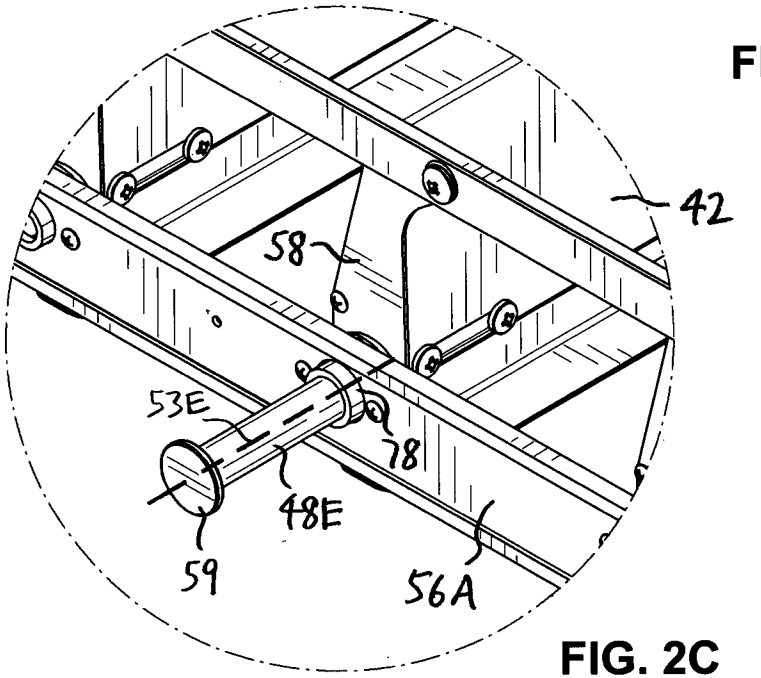
FIG. 2C is an isometric view of an extended pivot pin of the louver assembly of FIG. 2A extending from a side member.
Figure 2B:
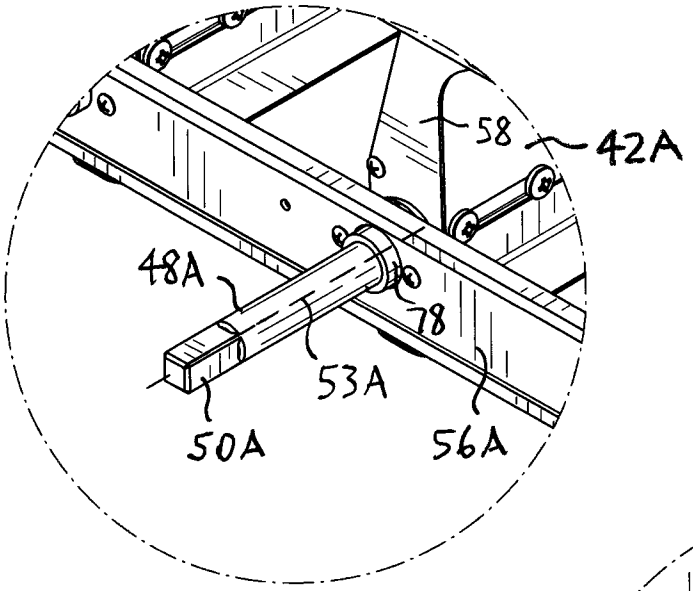
FIG. 2B is an isometric view of an end of a drive pin of the louver assembly of FIG. 2A extending from a side member, drawn at a larger scale.
Figure 2E:
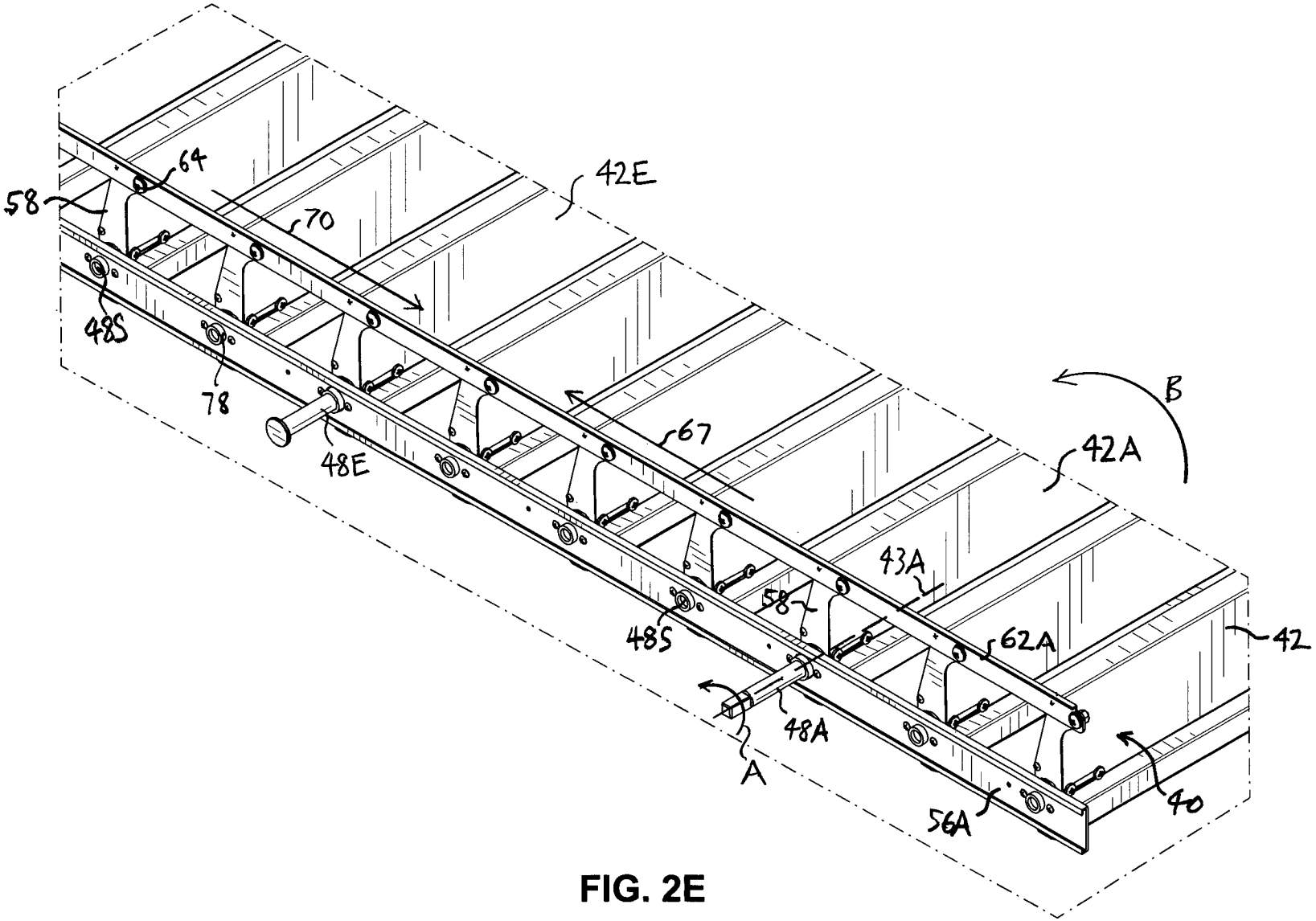
FIG. 2E is an isometric view of a portion of the louver assembly of FIG. 2A, drawn at a larger scale.
Figure 2F:
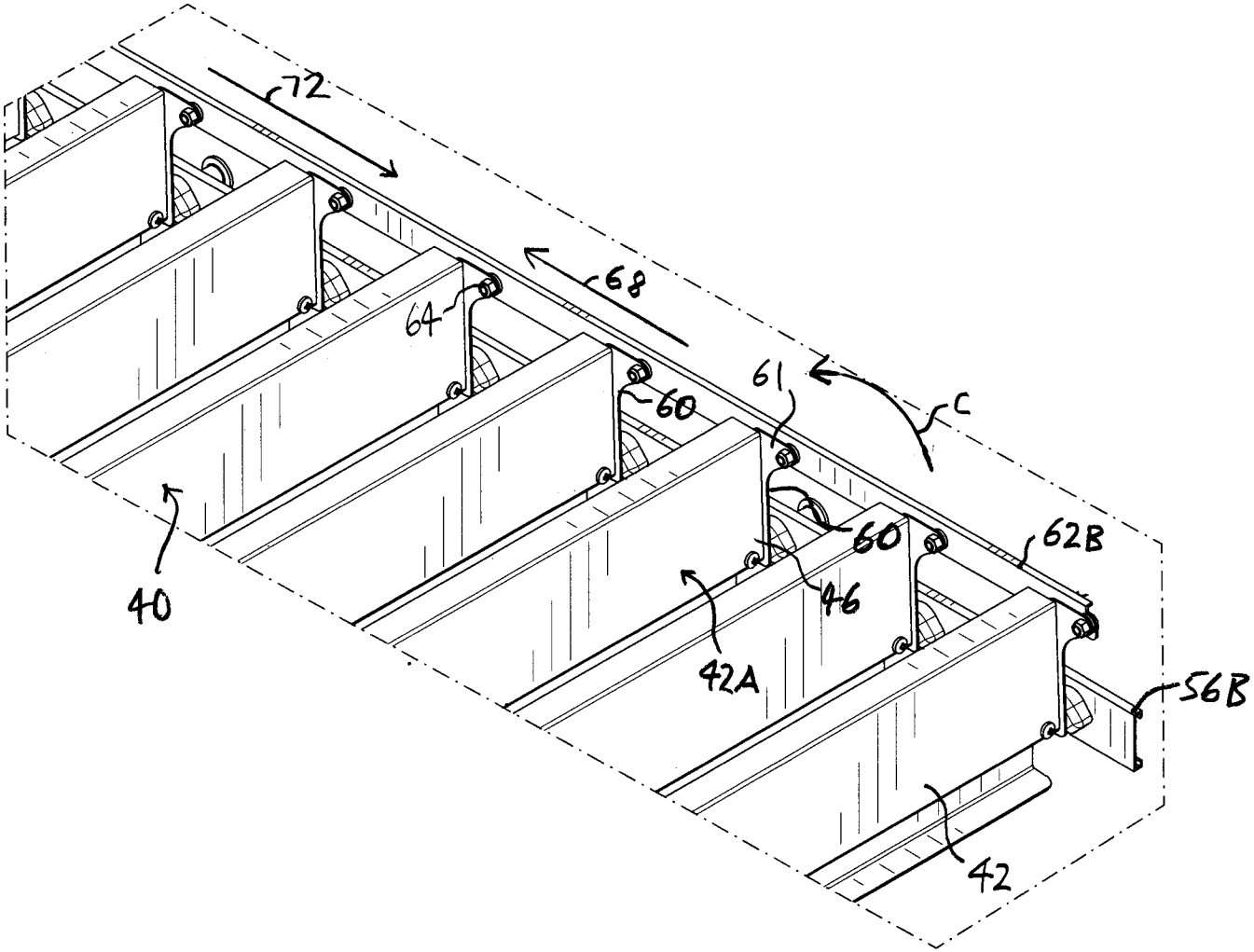
FIG. 2F is an isometric view of another portion of the louver assembly of FIG. 2A.
Figure 2G:
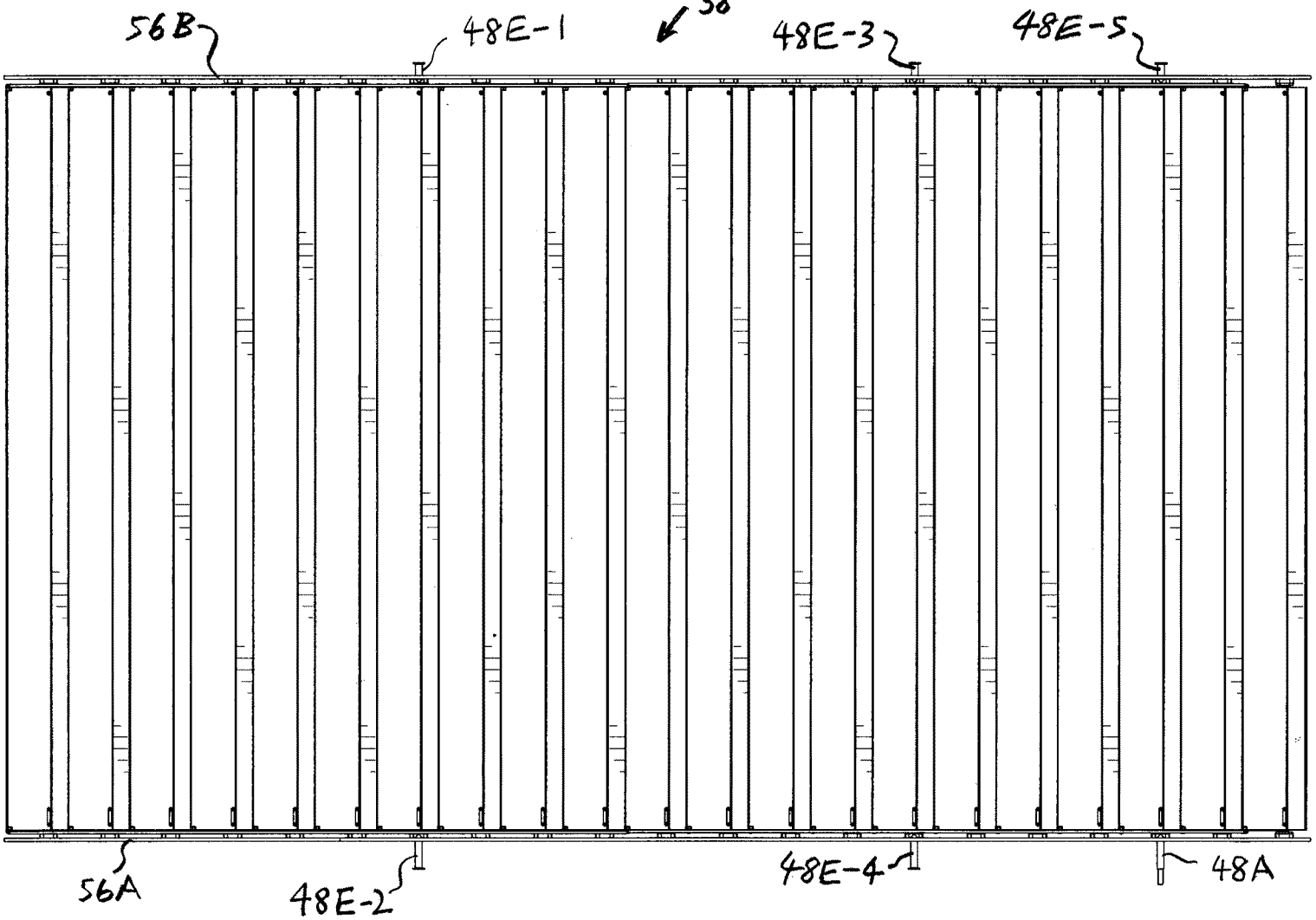
FIG. 2G is a top view of the louver assembly in the open condition thereof, drawn at a smaller scale.
Figure 2H:
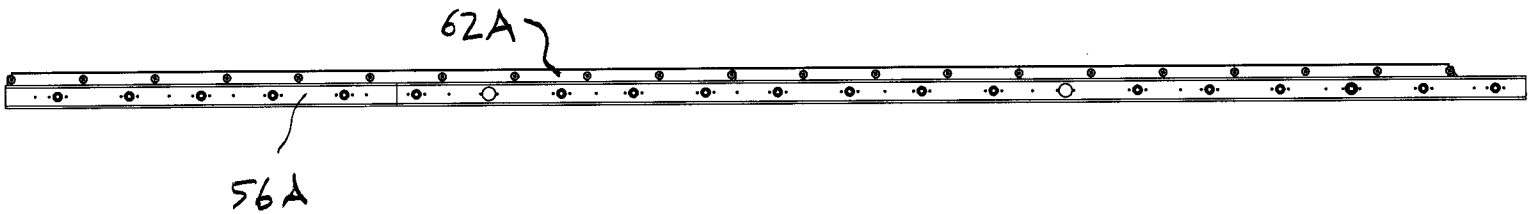
FIG. 2H is a side view of the louver assembly of FIG. 2G.

As can be seen in FIGS. 2A and 2G, the louver assembly 38 preferably extends between respective first and second side members 56A, 56B thereof, located parallel to each other. As will be described, the louver assembly 38 preferably is attached to the frame 24. Preferably, the first and second side members 56A, 56B are mounted to the second side elements 32A, 32B respectively.

Figure 3A:
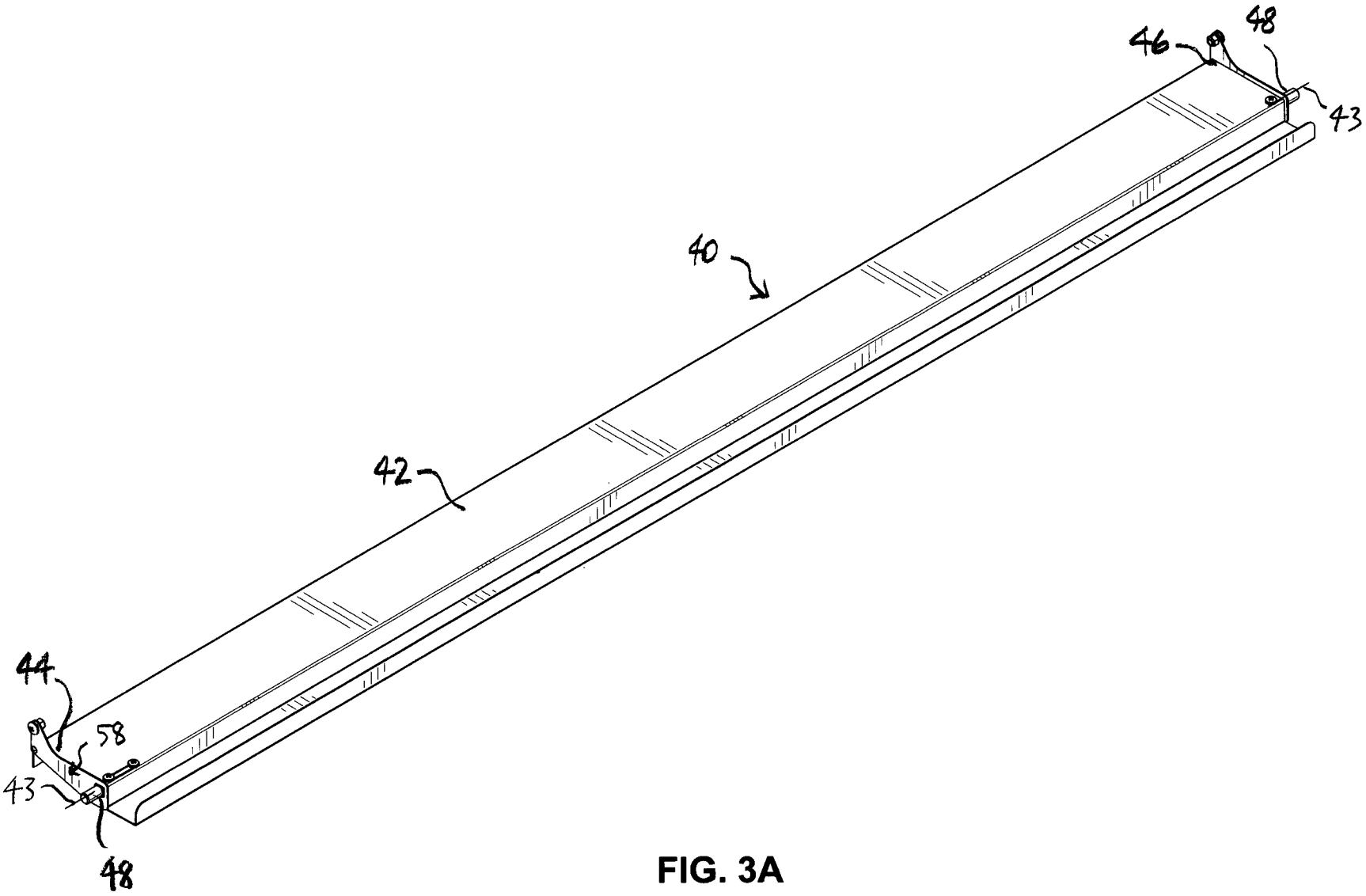
FIG. 3A is an isometric view of an embodiment of a slat subassembly of the invention including a slat body, drawn at a larger scale.

The louver assembly 38 preferably also includes a number of slat subassemblies 40, including respective slat bodies 42 (FIG. 3A). It is also preferred that the slat bodies 42 are pivotable about respective axes of rotation 43 thereof (FIGS. 3A, 3B) between respective closed positions thereof (FIGS. 1B, 3B), in which the slat bodies 42 cooperate with each other to collectively cover the aperture 22, and respective open positions thereof (FIG. 2A), in which the aperture 22 is at least partially uncovered. In one embodiment, when the slat bodies are in their closed positions, they are horizontal, or approximately horizontal.

Figure 3B:
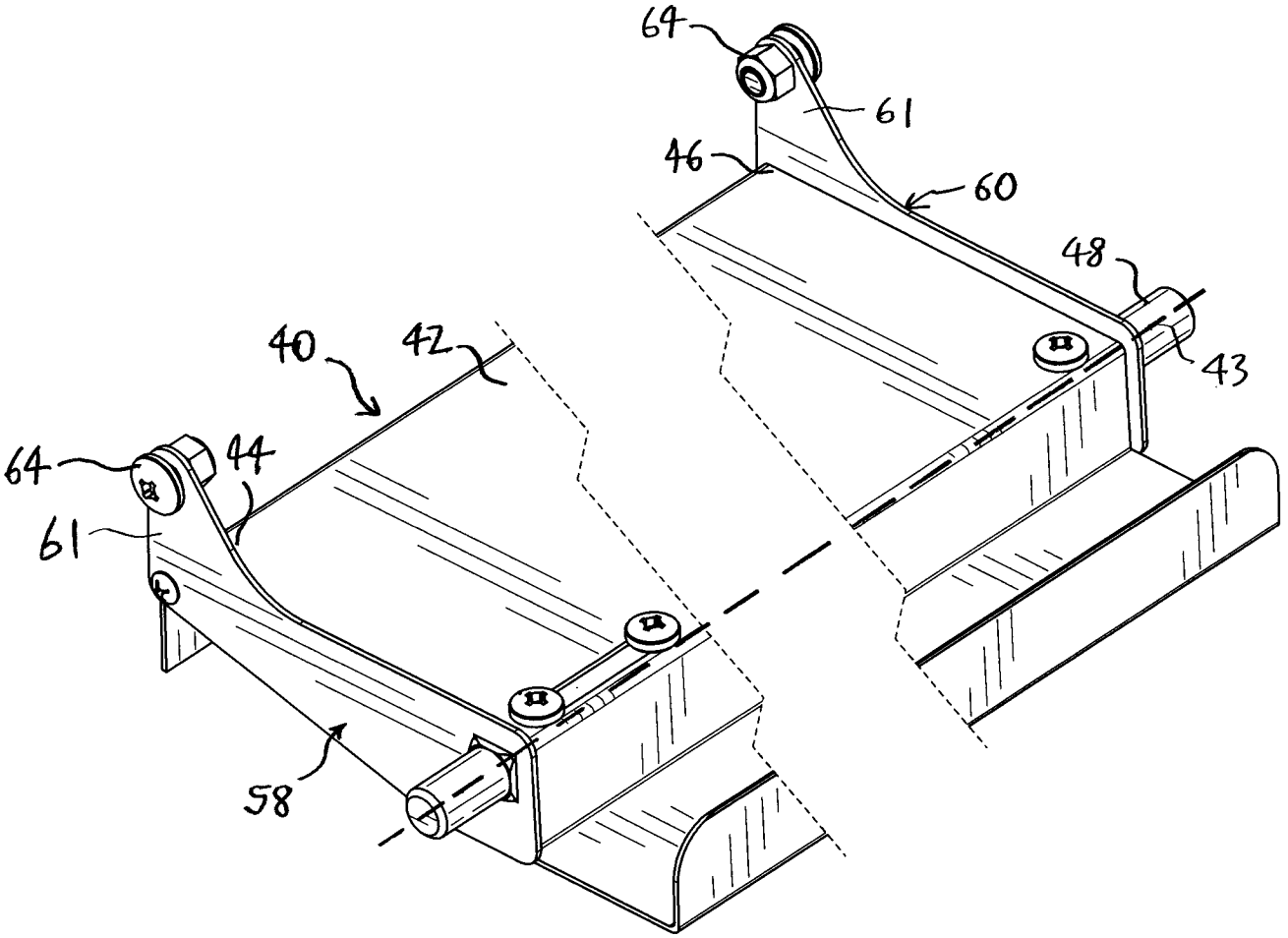
FIG. 3B is an isometric view of portions of the slat subassembly of FIG. 3A, drawn at a larger scale.

As can be seen in FIGS. 3A and 3B, each slat body 42 preferably extends between first and second ends 44, 46 thereof. The first and second ends 44, 46 preferably are located proximal to the first and second side members 56A, 56B of the louver assembly 38 respectively.

From the foregoing, it can be seen that the slat bodies 42 are movable between closed and open positions thereof. The slat bodies 42 preferably are also positionable in intermediate positions between the closed and open positions thereof (FIG. 3E). It will be understood that, when the slat bodies are in their closed positions, the louver assembly 38 is in a closed condition thereof (FIG. 1B), and when the slat bodies are in their open positions, the louver assembly 38 is in an open condition thereof (FIG. 2A).

In one embodiment, the louver system 20 preferably also includes a number of pivot pins 48 (FIGS. 2B-2F, 3A-3C). It will be understood that the pivot pins 48 preferably are of three types, the types having different lengths respectively (FIGS. 4A-4C).

Figure 3C:
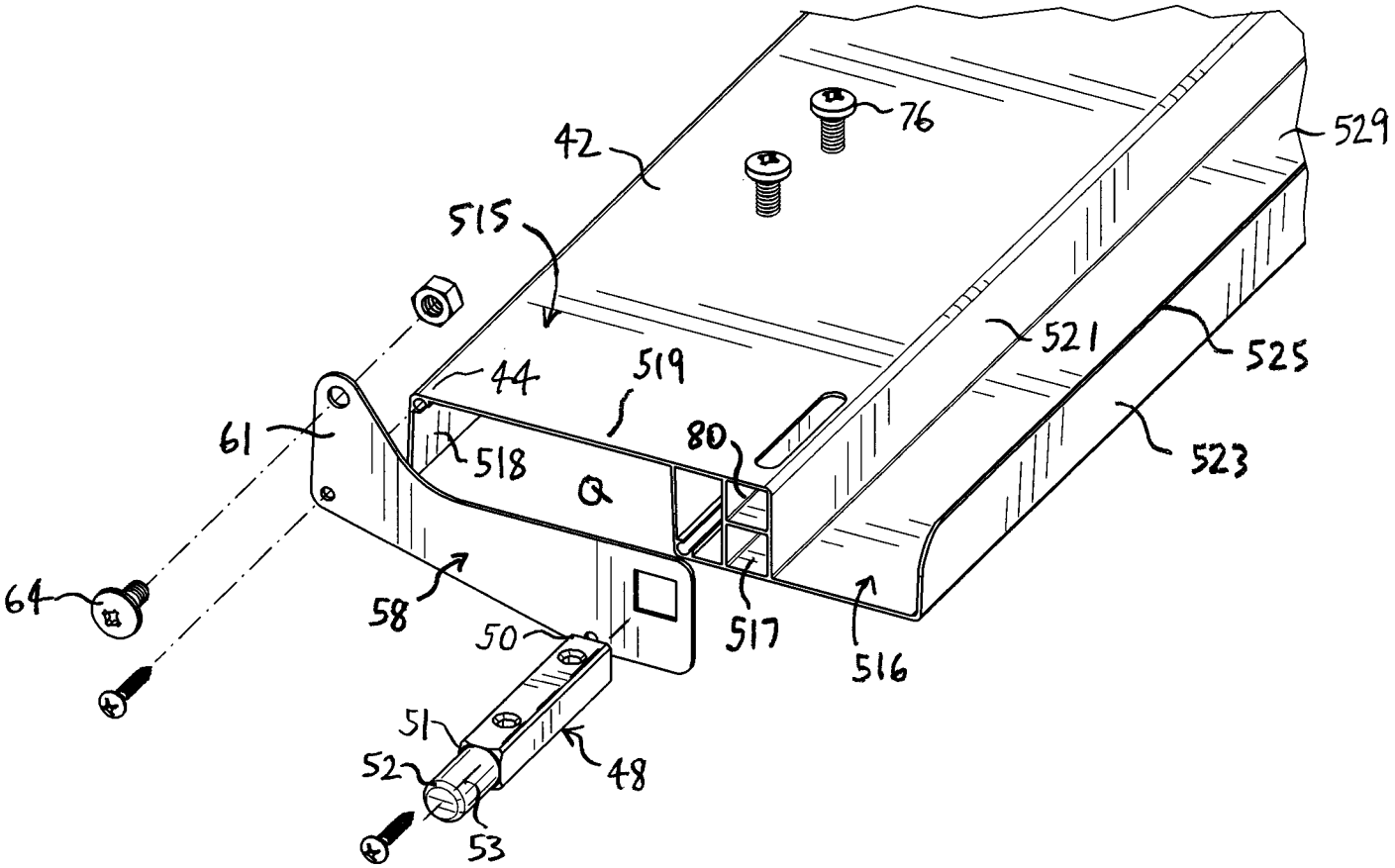
FIG. 3C is an isometric view of another portion of the slat subassembly of FIGS. 3A and 3B, drawn at a smaller scale.

Each pivot pin 48 preferably extends between an inner end 50 thereof mounted in a selected one of the first and second ends 44, 46 of a selected one of the slat bodies 42, and an outer end 52 thereof (FIGS. 3C-7). Each pivot pin 48 has an axis of rotation 53 thereof (FIG. 3C). Preferably, each pivot pin is mounted coaxially with the axis of rotation 43 of the selected one of the slat bodies in which the inner end 50 thereof is located. As will also be described, it is preferred that the outer end 52 extends beyond the end 44, 46 of the slat body 42 in which the inner end 50 is located. Each pivot pin 48 preferably also includes an intermediate segment 51 thereof, located between the inner and outer ends 50, 52 thereof.

Figure 4A:
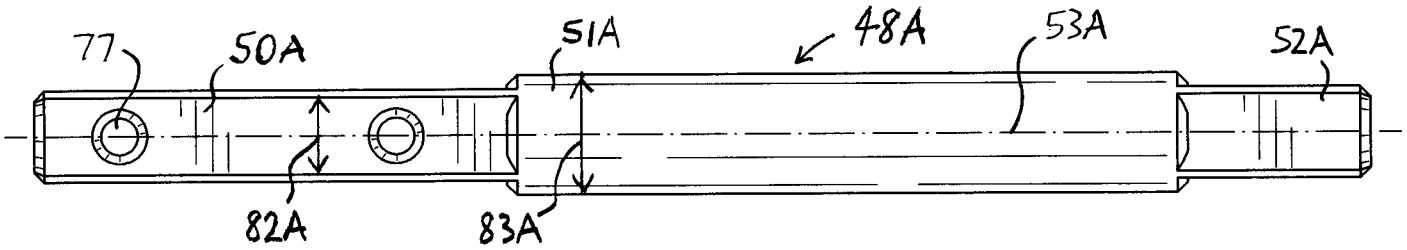
FIG. 4A is a plan view of the drive pin of FIG. 2B, drawn at a larger scale.
Figure 4B:
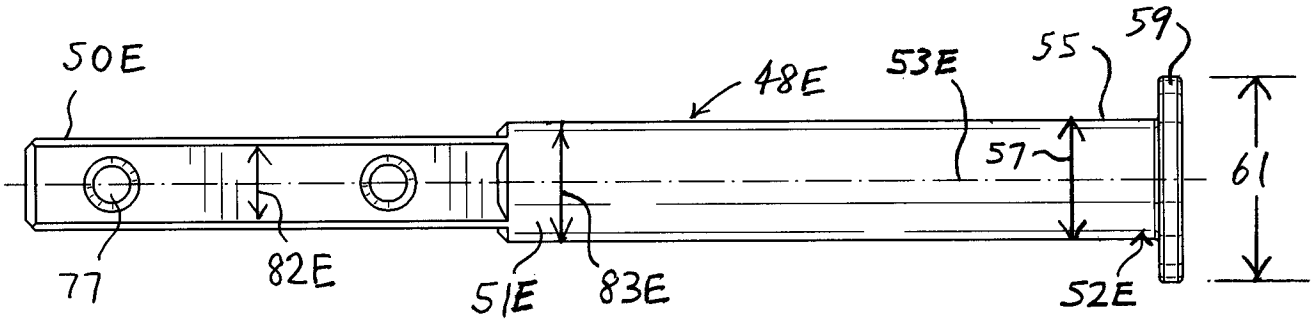
FIG. 4B is a plan view of the extended pivot pin of FIG. 2C.
Figure 5A:
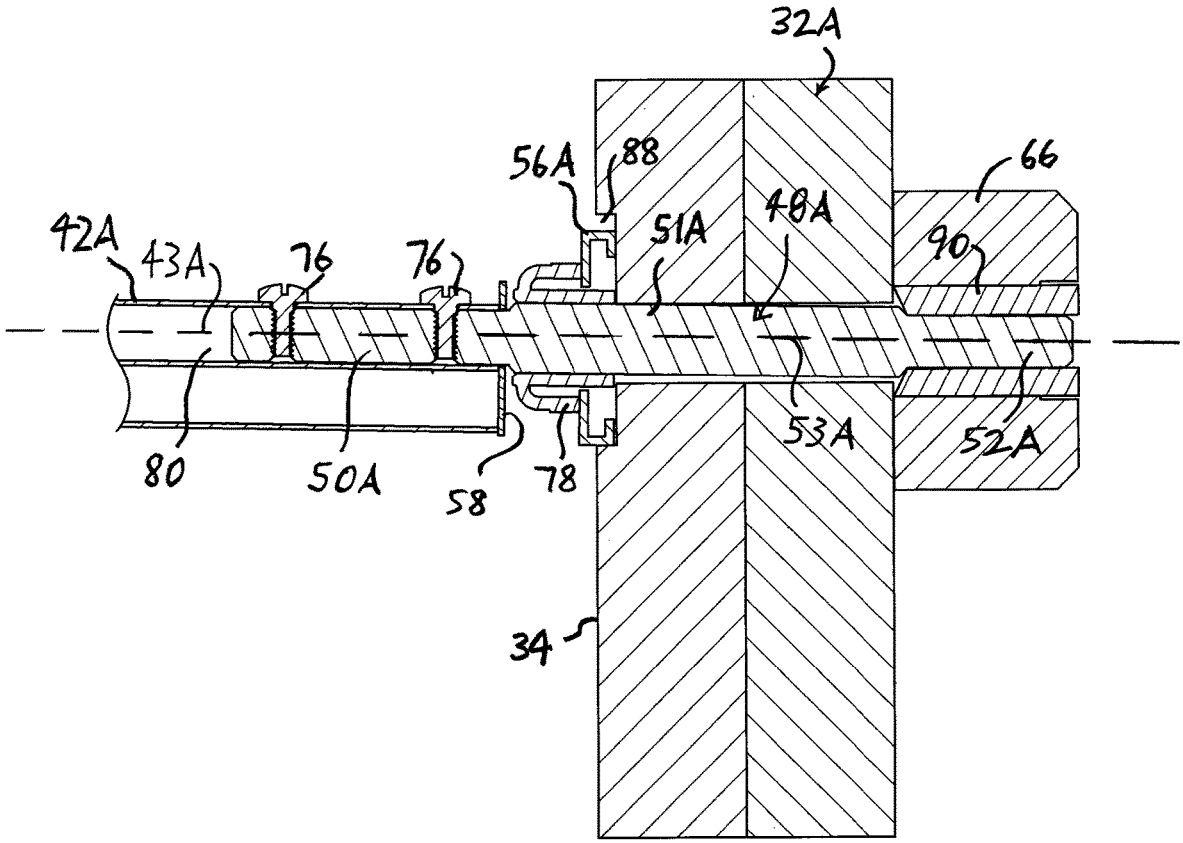
FIG. 5A is a cross-section of the drive pin of FIGS. 2B and 4 mounted in a side element of the frame, drawn at a smaller scale.
Figure 5B:
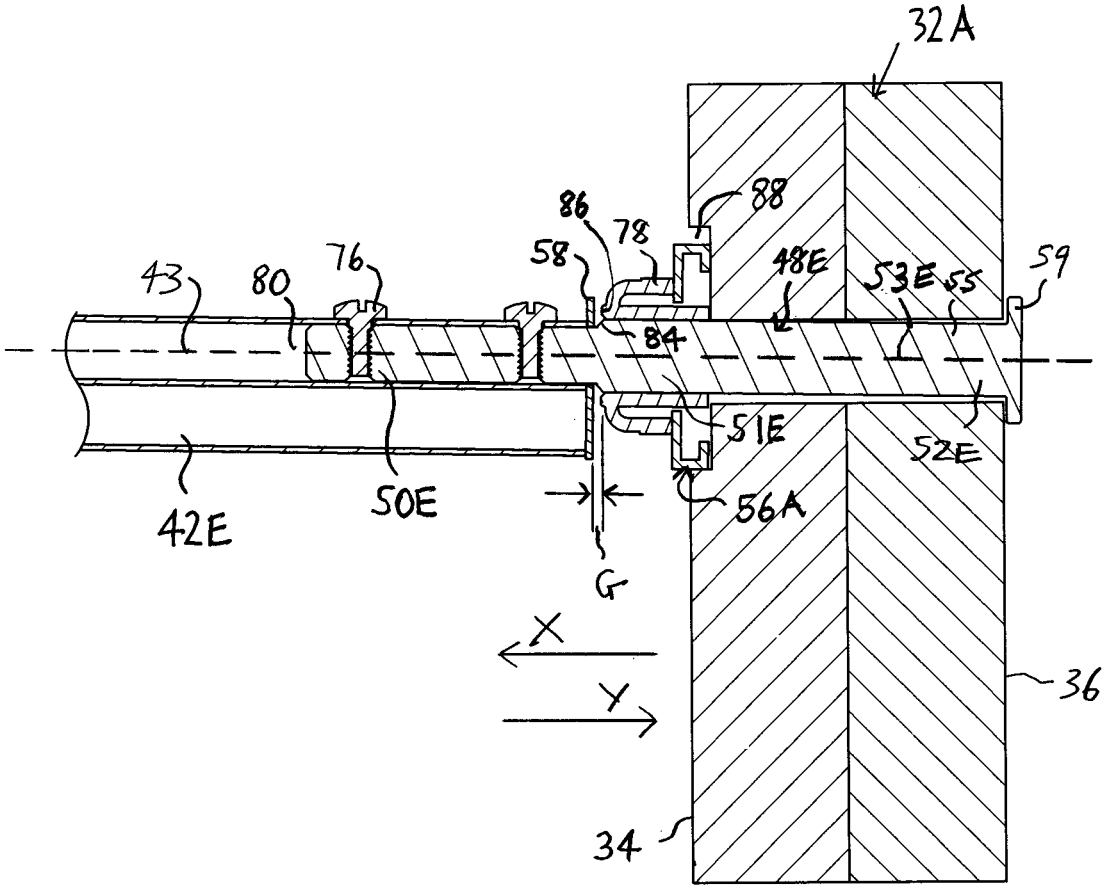
FIG. 5B is a cross-section of the extended pivot pin of FIGS. 2C and 4B mounted in the side element.

In one embodiment, the pivot pins 48 preferably include one or more extended pivot pins 48E (FIGS. 4B, 5B). The inner end 50E of the extended pivot pin 48E preferably is located in a selected one of the slat bodies, identified for convenience by reference character 42E in FIGS. 2E and 5B. As can be seen in FIG. 5B, it is preferred that outer end 52E of the extended pivot pins 48E is formed to be partially positioned in a selected one of the first and second side elements 32A, 32B. The outer end 52E is also partially formed to engage the outer side 36 of the selected one of the side elements 32A, 32B. The extended pivot pin 48E preferably is configured to at least partially rotatably secure the slat body 42E between the side members 56A, 56B, to partially locate the louver assembly 38 in the aperture 22 (FIG. 5B).

A cross-section of the side element 32A, and the extended pivot pin 48E partially positioned therein, is illustrated in FIG. 5B. It will be understood that the partial positioning of the extended pivot pin 48E in the other side element 32B is the same, in all relevant respects.

As will be described, each of the pivot pins 48 preferably is positioned coaxially with the slat body 42 in which the inner end 50 of each of the pivot pins 48 is respectively secured. For example, the axis of rotation 53E of the extended pivot pin 48E is aligned with the axis of rotation 43 of the slat body 42E (FIG. 5B).

Those skilled in the art would appreciate that the aperture 22 may have any suitable shape. For instance, as illustrated in FIG. 1C, in one embodiment, the aperture 22 preferably is rectangular. As can be seen in FIGS. 1B and 1C, the frame 24 preferably includes first and second side elements 32A, 32B and first and second end elements 54A, 54B that define the aperture 22. Preferably, the louver assembly 38 is mounted in the frame 24 so that the slat bodies 42 are positioned parallel to the first and second end elements 54A, 54B, and orthogonal to first and second side elements 32A, 32B. As can be seen in FIG. 1C, the first end element 54A connects the first and second side elements 32A, 32B at respective first ends 37A, 37B thereof, and the second end element 54B connects the first and second side elements 32A, 32B at respective second ends 39A, 39B thereof, so that the first and second end elements 54A, 54B partially define the aperture 22.

Figure 5C:
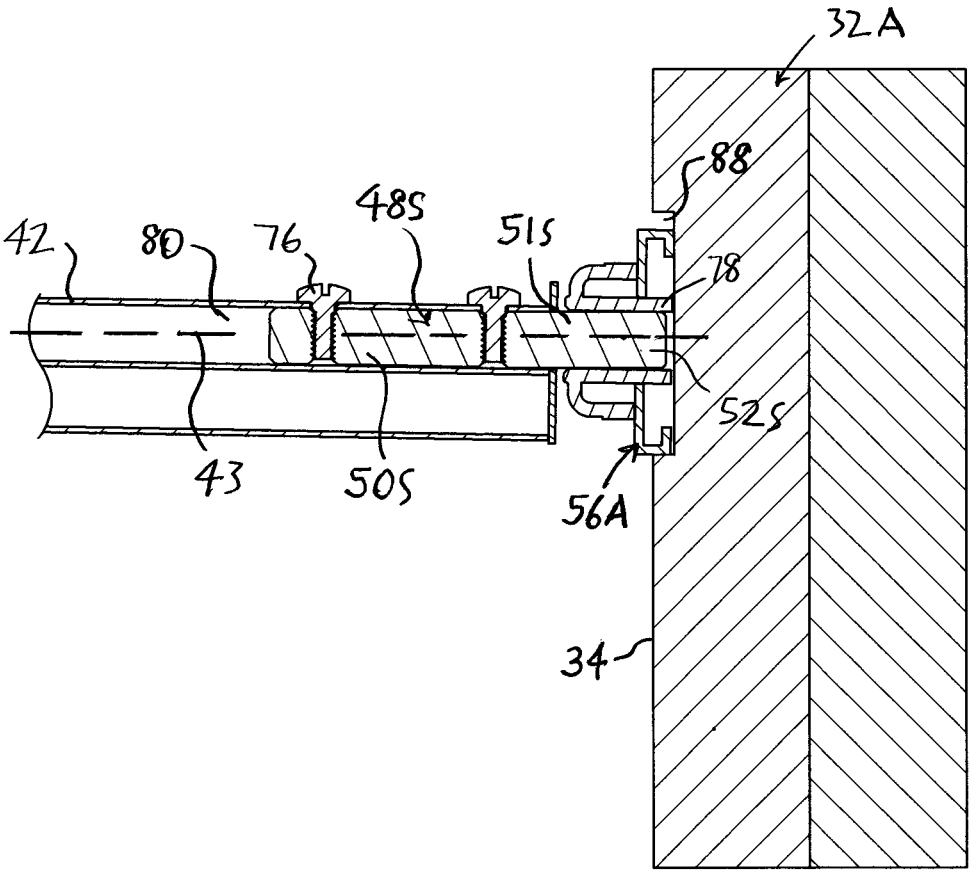
FIG. 5C is a cross-section of the standard pivot pin of FIGS. 2D and 4C mounted in the side element.

In one embodiment, the louver assembly 38 preferably includes the elongate side members 56A, 56B (FIGS. 2A, 2E, 2F). As will be described, the intermediate segments 51 of the pivot pins 48 preferably are at least partially positioned in the side members 56A, 56B, for rotation of the pivot pins 48 about their respective axes of rotation 53. When the louver assembly 38 is mounted to the frame 24, the side members 56A, 56B are mounted into the inner sides 34 of the first and second side elements 32A, 32B respectively, as will also be described (FIGS. 5A-5C). As can be seen in FIG. 1B, the side members 56A, 56B preferably are located parallel to the first and second side elements 32A, 32B.

As will be described, the extended pivot pins 48E are configured to locate the side members 56A, 56B in predetermined respective positions relative to the inner sides 34 of the respective first and second side elements 32A, 32B. In one embodiment, the outer end 52E of the extended pivot pin 48E preferably includes an outer end segment 55 having an outer end segment diameter 57 (FIG. 4B). It is also preferred that the outer end 52E preferably includes a head portion 59 having a head portion diameter 61 that is greater than the outer end segment diameter 57 (FIG. 4B). As can be seen in FIG. 5B, the head portion 59 is formed to engage the outer side 36 of the selected one of the first and second side elements 32A, 32B in which the outer end 52E is partially located.

As will be described, all of the pivot pins 48, located in the first and second ends 44, 46 of the respective slat bodies 42, are at least partially received in the side members 56A, 56B, at predetermined intervals along the lengths of the side members 56A, 56B (FIGS. 2A, 2G). Each pivot pin is also partially received in one of the ends 44, 46 of one of the slat bodies 42. Preferably, each of the slat bodies 42 is pivotable about the axis of rotation 43 of that slat body 42. The pivot pins 48 that are mounted in the first and second ends 44, 46 of a particular slat body 42 preferably are, at least in part, coaxial with the axis of rotation 43 of that slat body 42.

It will be understood that, as described above, the extended pivot pins 48E are formed to secure the louver assembly 38 to the side elements 32A, 32B in order to support the louver assembly 38 in the aperture 22. As can be seen in FIG. 2G, for example, in one embodiment, the louver assembly 38 may include five extended pivot pins, identified for convenience by reference characters 48E-1 to 48E-5 respectively. In the example illustrated in FIG. 2G, the extended pivot pins 48E-1 and 48E-2 are positioned on opposite sides of the louver assembly 38, for securing the louver assembly 38 to the frame assembly 24, to support the louver assembly 38 in the aperture 22.

From the foregoing, it can be seen that, in one embodiment, the louver system 20 preferably includes two or more extended pivot pins 48E. For example, at a minimum, the louver system 20 may include a first and a second extended pivot pin, e.g., the extended pivot pins identified in FIG. 2G by reference characters 48E-1 and 48E-2. Preferably, the first and second extended pivot pins 48E-1, 48E-2 are partially located in the first and second side elements 32B, 32A respectively (not shown in FIG. 2G).

As can be seen in FIG. 5B, the head portion 59 of each of the extended pivot pins engages the outer side 36 of the side element in which the extended pivot pin 48E is partially located. Also, the inner end 50E of each of the extended pivot pins is secured in an end 44, 46 of a selected slat body 42E to rotatably secure the selected slat body 42E between the first and second side members 32A, 32B respectively, to at least partially secure the louver assembly 38 between the side elements 32A, 32B.

As can be seen in FIG. 2G, it is preferred that pairs of the extended pivot pins are horizontally spaced apart from each other, for supporting the louver assembly 38 in the frame 24. For instance, in FIG. 2G, the extended pivot pins 48E-3 and 48E-4 are spaced apart from the extended pivot pins 48E-1 and 48E-2 respectively.

As can be seen in FIG. 3B, in one embodiment, the slat subassembly 40 preferably includes end plates 58, 60, positioned at the respective first and second ends 44, 46 of the slat body 42. Preferably, each of the end plates 58, 60 is configured to include a raised or protruding portion 61 (FIGS. 2E, 2F) to which a connecting arm 62 (FIG. 2A) may be pivotably connected, e.g., by a suitable fastener 64.

As can be seen in FIGS. 2A, 3A, and 3B, it is preferred that each of the slat subassemblies 40 includes the end plates 58, 60 mounted at each end 44, 46 of the slat body 42. The louver assembly 38 preferably also includes first and second connecting arms 62A, 62B, i.e., one located on each side of the louver assembly 38 (FIG. 2A). The connector arms 62A, 62B are proximal to the side members 56A, 56B of the louver assembly 38 (FIGS. 2E, 2F).

Each of the connecting arms 62A, 62B preferably is pivotably connected to the end plates 58, 60 on the slat bodies 42 on one side of the louver assembly 38. As will be described, the connecting arms 62A, 62B join the slat subassemblies 40 in the louver assembly 38 together along each side of the louver assembly 38 respectively, to cause the slat bodies 42 to pivot in unison about their respective axes of rotation 43 between the closed and open positions thereof, upon movement of the connecting element 62A, 62B along the length thereof.

Figure 9A:
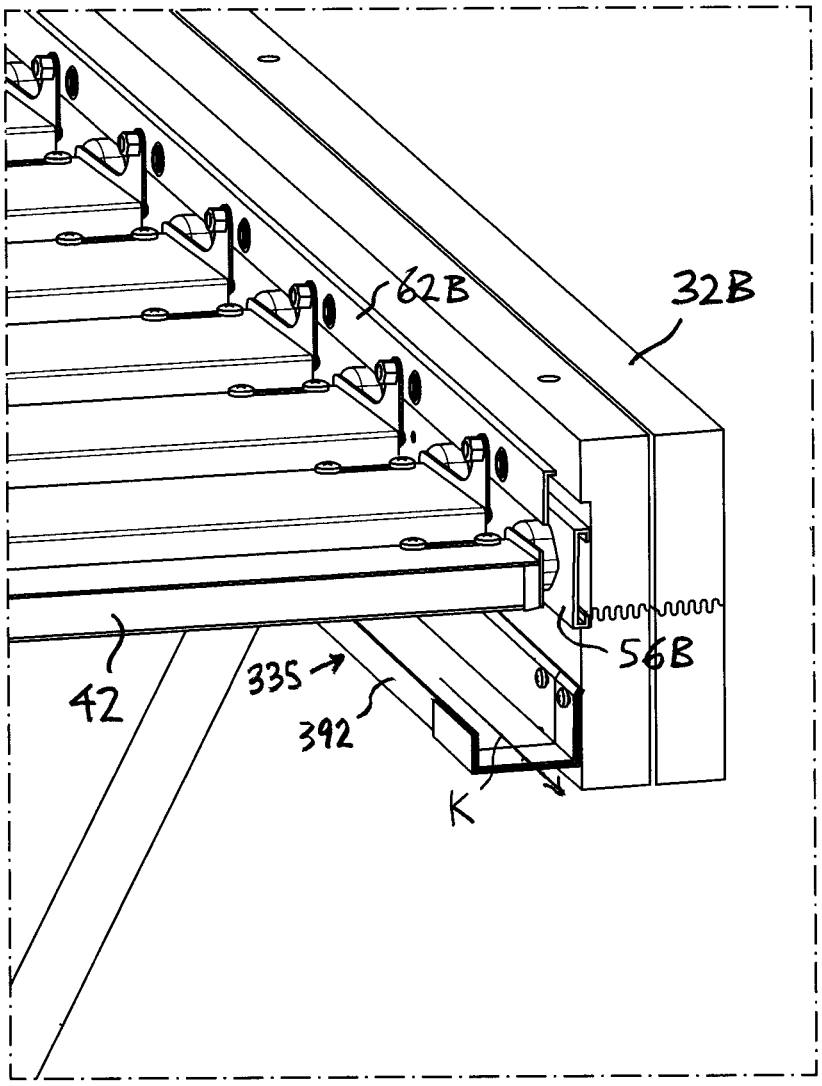
FIG. 9A is an isometric view of a portion of the louver assembly mounted to the frame assembly and a gutter mounted to the frame assembly, drawn at a smaller scale.

It will be understood that, due to the configuration of the protruding portion 61, the connecting arms 62A, 62B are raised or lowered relative to the side members 56A, 56B to which they are respectively proximal when the slat bodies 42 rotate about their respective axes of rotation 43. For example, the slat bodies 42 are in their open positions in FIG. 2A, and the connecting arms 62A, 62B are raised relative to the side members 56A, 56B respectively. As can be seen in FIG. 9A, when the slat bodies 42 are in their closed positions, the connecting arm 62B is positioned lower, relative to the side member 56B. The position of the connecting arm 62A relative to the side member 56A when the slat bodies are in their closed positions, or almost in the closed positions, can be seen in FIG. 2H.

Preferably, the slat bodies 42 are locatable in any selected position that is between the open and closed positions. Because the connecting arms 62A, 62B connect the slat bodies 42 together for pivoting in unison, rotation of one of the slat bodies 42 about its axis of rotation 43 causes corresponding movement of all of the other slat bodies 42 in the louver assembly 38. As will be described, in one embodiment, movement of the slat bodies 42 between the closed and open positions thereof preferably is initiated by movement of only one of the slat bodies 42.

Preferably, one or more of the pivot pins 48 is a drive pin 48A (FIGS. 2A, 2B, 4A, 5A). The drive pivot pin 48A has an axis of rotation 53A (FIG. 4A). An outer end 52A of the drive pin 48A preferably is configured to be rotated by a drive mechanism 66 (FIG. 5A). The drive mechanism 66 may be any suitable drive mechanism. Those skilled in the art would be aware of suitable drive mechanisms. Preferably, the outer end 52A is configured for engagement with the drive mechanism 66, so that the outer end 52A of the drive pin 48A can be rotated by the drive mechanism 66. In one embodiment, for example, and as can be seen in FIGS. 2B, 4A, and 5A, the outer end 52A may have a square cross-section configured for engagement by the drive mechanism 66, so that the drive pin 48A may be rotated by the drive mechanism 66.

For convenience, the slat body 42 to which the drive pin 48A is attached is identified by reference character 42A, and the axis of rotation of the slat body 42A is identified by reference character 43A (FIGS. 2E, 4A, 5A). As will be described, rotation of the drive pin 48A in one axial direction causes the slat body 42A to rotate in the same axial direction. As will also be described, the rotation of the slat body 42A in turn causes substantially simultaneous corresponding rotation of the other slat bodies in the louver assembly 38.

As can be seen in FIG. 2E, for example, counterclockwise rotation of the outer end 52A (indicated by arrow "A" in FIG. 2E) causes corresponding counterclockwise rotation of the slat body 42A about an axis of rotation 43A thereof (indicated by arrow "B" in FIG. 2E). This rotation in turn causes corresponding counterclockwise rotation of an end plate 58 secured to a first end 44A of the slat body 42A. Such rotation of the end plate 58 in turn causes the connecting arm 62A that is connected to the end plate 58 to move in the direction indicated by arrow 67 in FIG. 2E.

From FIGS. 2E and 2F, it can be seen that, when counterclockwise rotation of the drive pin 48A is initiated (as viewed in FIGS. 2E and 2F), causing rotation of the slat body 42A in the same direction about its axis of rotation 43A, corresponding counterclockwise rotation of the second end 46 of the slat body 42A is also initiated (indicated by arrow "C" in FIG. 2F). This causes corresponding rotation of the end plate 60, which in turn causes the connecting arm 62B to move in the direction indicated by arrow 68 (FIGS. 2A, 2F).

The connecting arm 62A is rotatably connected to all of the end plates 58 that are proximal to the side member 56A of the louver assembly 38, and the connecting arm 62B is rotatably connected to all of the end plates 60 that are proximal to the side member 56B of the louver assembly 38. As noted above, such movement of the connecting arms 62A, 62B is initiated by rotation of the slat body 42A. Accordingly, it can be seen that the movement of the connecting arms 62A, 62B in the direction indicated by the arrows 67, 68 causes the slat bodies, other than the drive slat body 42A, to rotate about their respective axes of rotation in the counterclockwise direction, in unison with movement of the slat body 42A. In this way, rotation of the drive pin 48A, initiated by the drive mechanism 66, causes substantially uniform movement of all the slat subassemblies in the louver assembly 38.

From the foregoing, it can be seen that rotation of the drive pivot pin 48A in the opposite (clockwise) direction has the opposite effect. As viewed in FIG. 2E, clockwise rotation of the outer end 52A of the drive pin 48A causes corresponding clockwise rotation of the slat body 42A about the axis of rotation 43A. This rotation in turn causes corresponding clockwise rotation of the end plate 58 on the slat body 42A. Such rotation of the end plate causes the connecting arm 62A to move in the direction indicated by arrow 70 in FIG. 2E.

Similarly, the clockwise rotation of the slat body 42A about its axis of rotation 43A causes corresponding clockwise rotation of the end plate 60A. This in turn causes the connecting arm 62B that is rotatably connected to the end plate 60A to move in the direction indicated by arrow 72 (FIG. 2F). In summary, clockwise rotation of the drive pin 48A results in substantially uniform clockwise rotation of the slat bodies 42 of the louver assembly 38.

Accordingly, the slat bodies 42 of the louver assembly 38 may be moved between the closed and open positions thereof, and to any intermediate positions therebetween, by suitable rotation of the drive pin 48A. Each slat subassembly 40 is pivotably connected to the two connecting arms 62A, 62B (i.e., at the end plates 58, 60 of each slat subassembly respectively), so that movement of the slat body 42A (i.e., clockwise or counterclockwise rotation about the slat body's axis of rotation 43A) causes corresponding movement of the other slat bodies 42, substantially in unison.

As can be seen in FIG. 4A, the drive pin 48A preferably includes the inner end (identified by reference character 50A for convenience) and an intermediate segment 51A, between the inner end 50A and the outer end 52A. The slat body 42A preferably includes a channel 80 formed therein, with a square cross-section proximal to the end of the slat body 42 (FIG. 5A). Preferably, the inner end 50A has a width 82A formed so that the inner end 50A is receivable in the channel 80.

The intermediate segment 51A preferably has a round cross-section, with an intermediate portion diameter 83A. As can also be seen in FIG. 5A, the inner end 50A is secured in the channel 80 in the slat body 42A by the fasteners 76. Preferably, the inner end 50A includes holes 77 in which the fasteners are receivable (FIG. 5A).

The side member 56A preferably includes a bushing 78A in which part of the intermediate segment 51A is receivable. The intermediate segment 51A is formed to be rotatable about the axis of rotation 53A in the side element 32A, and in the bushing 78 (FIG. 5A).

Preferably, the drive pin 48A is positioned coaxial with the axis of rotation 43A of the slat body 42A (FIG. 5A). The outer end 52A is engageable by the drive mechanism 66. It is preferred that the drive mechanism 66 includes one or more engagement elements 90 that securely engage the outer end 52A of the drive pin 48A, so that the drive mechanism 66 can rotate the outer end 52A about the axis of rotation 43A. Accordingly, the drive pin 48A is rotatable about its axis 53A by the drive mechanism 66.

From the foregoing, it can be seen that the rotation of the drive pin 48A about the axis 53A, which is initiated by the drive mechanism 66, causes the slat body 42A to rotate about the axis of rotation 43A in the same direction, and by the same radial distance, as the drive pin 48A rotates about the axis of rotation 43A. Rotation of the drive pin 48A about its axis 53A causes corresponding rotation of the slat body 42A.

As described above, due to the connections of the connector arms 62A, 62B with the slat subassemblies, the other slat bodies are movable in unison, with the slat body 42A, and with each other. Accordingly, when the drive mechanism 66 initiates rotation of the slat body 42A about its axis of rotation 43A, such rotation of the slat body 42A causes corresponding rotation of the other slat bodies 42 about their respective axes of rotation 43.

As can be seen in FIG. 5A, the louver assembly 38 is prevented from outward movement (i.e., at the side element 32A) by the end plate 58. If the louver assembly 38 were to shift to the right, as viewed in FIG. 5A, the end plate 58 would engage the side member 56A.

It will be understood that the extended pivot pins 48E are spaced apart from each other along the longer side members 56A, 56B of the louver assembly 38. For example, in FIG.

2A, only two extended pivot pins 48E are shown, mounted in the side member 56A of the louver assembly 38.

The extended pivot pin 48E can be seen in FIG. 5B, with the head portion 59 of the outer end 52E engaging the outer side 36 of the side element 32A. The inner end 50E of the extended pivot pin 48E preferably is secured to the slat body 42E, e.g., by suitable fasteners 76 (FIG. 5B). The extended pivot pin 48E is also illustrated in FIG. 4B. The inner end 50E preferably includes holes 77 in which the fasteners 76 are receivable.

Preferably, the side members 56A, 56B each include bushing portions 78E (FIG. 5B). As can be seen in FIG. 4B, the inner end 50E preferably has an inner end width 82E. The inner end 50E preferably is received in the channel 80E formed in the slat body 42E (FIG. 5B). The inner end 50E is firmly secured in the channel 80E by the fasteners 76.

Preferably, the channel 80E is square in its cross-section, and the inner end 50E is also square in cross-section, and formed to be received in the channel 80E. It is also preferred that the outer end 52E of the extended pivot pin 48E is round in cross-section, with a diameter 83E (FIGS. 4B, 5B). The outer end 52E extends between the head portion 59 and the intermediate segment 51E. An inside end 84 defines an inner side of the intermediate segment 51E (FIG. 5B). The outer end 52E preferably is formed so that it fits in the first side element 32A. The intermediate segment 51E also fits into the bushing 78, to permit rotation of the extended pivot pin 48E. As can be seen in FIG. 5B, it is preferred that the inside end 84 is located at an inner side 86 of the bushing 78, to define a gap "G" between the inside end 84 and the end plate 58.

The extended pivot pin 48E has a central axis 53E (FIG. 4B). Preferably, and as illustrated in FIG. 5B, the extended pivot pin axis 53E is aligned with an axis of rotation 43E of the slat body 42E.

From the foregoing, it can be seen that, because of its dimensions, the extended pivot pin 48E holds the louver assembly 38 between the side elements 32, and tends also to hold the side elements 32A, 32B in position, spaced apart from each other to partially define the aperture 22.

Those skilled in the art would appreciate that, in certain situations, there may be downward pressure on the slat subassemblies 40. In particular, if the slat bodies 42 are in the closed position and snow accumulates thereon, then the weight of the snow tends to pull the extended pivot pin 48E inwardly, i.e., in the direction indicated by arrow "X" in FIG. 5B. Because of this, the extended pivot pin 48E includes the head portion 59, which engages the outer side 36 of the side member 32A, when the extended pivot pin 48E is pulled inwardly.

There may also be situations where one or more of the slat subassemblies 40 may shift outwardly, i.e., in the direction indicated by arrow "Y" in FIG. 5B. As can be seen In FIG. 5B, because the gap "G" is relatively small, only a small outward movement would be possible before the end plate 58 engages the inner side 86 of the bushing 78, which would prevent any further outward movement of the slat subassemblies 40.

In one embodiment, each of the side members 56A, 56B preferably is configured to fit into a slot opening 88 that is formed in the inner sides 34 of the side elements 32A, 32B respectively (FIGS. 5A-5C). As an example, as can be seen in FIG. 5B, the side member 56A preferably fits into the slot 88 in the side member 32A.

It will be understood that the extended pivot pins 48E that are located on the other side of the louver assembly 38, which are partially located in the side member 56B and the side element 32B, are positioned in substantially the same way as illustrated in FIG. 5B, in a mirror image thereof. From the foregoing, it can be seen that the extended pivot pins 48E perform two functions: (i) the extended pivot pins locate the louver assembly 38 and secure it to the frame assembly 24, and (ii) the extended pivot pins permit rotation of the slat bodies 42E about their respective axes of rotation 43.

As can be seen in FIG. 2G, in one embodiment, one of the extended pivot pins preferably is located opposite to the drive pivot pin 48A. The extended pivot pin 48E-5 is mounted in the side member 56B, opposite to the drive pivot pin 48A, which is mounted in the other side member 56A. It will be understood that all of the extended pivot pins 48E-1, 48E-3, and 48E-5 are rotatably secured in the side element 32B (not shown in FIG. 2G). It will also be understood that the extended pivot pins 48E-2 and 48E-4 are mounted in the side member 56A, and rotatably secured in the side element 32A (not shown in FIG. 2G). Those skilled in the art would appreciate that the pivot pin 48E-5 is spaced apart from the pivot pin 48E-3 and also from the drive pivot pin 48A to provide support to the louver assembly 38 and to secure the louver assembly 38 to the frame 24 (not shown in FIG. 2G).

As can be seen in FIGS. 2A, 2D, and 2E, it is preferred that the standard pivot pins are mounted in the slat bodies 42 and in the side members 56A, 56B at a number of locations along the length of the louver assembly 38. For convenience, the standard pivot pins are identified by the reference character 48S.

The standard pivot pins 48S are shown mounted in the slat body 42 in FIGS. 3A-3C. As can be seen in FIGS. 4C and 5C, the standard pivot pin 48S preferably includes inner and outer ends 50S, 52S thereof, and an intermediate segment 51S therebetween. The standard pivot pin 48S is defined by an axis 53S (FIG. 4C). The inner end 50S preferably has a square cross-section, so that it can be received and secured in the channel 80 in the slat body 42. It is preferred that the inner end 50S is secured in the channel 80 by the fasteners 76 (FIG. 5C). Preferably, the inner end 50S includes openings 77 in which the fasteners 76 are receivable. The standard pivot pin 48S, once secured in the channel 80, preferably is located coaxially with the axis of rotation 43 of the slat body 42 in which the inner end 50S is secured (FIG. 5C).

The outer end 52S preferably is round in cross-section. As can be seen in FIG. 5C, the side member 56A preferably is mounted in the slot 88 in the side element 32A, and a bushing 78 is mounted in the side member 56A. Preferably, the outer end 52S is located in the bushing 78, and the outer end 52S is rotatable about the axis of rotation 53S relative to the bushing 78 (FIG. 5C).

As can be seen in FIG. 5C, it is preferred that the pivot pin 48S is coaxial with the axis of rotation 43 of the slat body 42 in which the inner end 50S of the pivot pin 48S is secured.

It will be understood that the standard pivot pins 48S that are located on the other side of the louver assembly 38, which also have outer ends 52S that are partially located in the side member 56B, are positioned in bushings 78S in slots 88 in the side element 32B, in substantially the same way as illustrated in FIG. 5C, in a mirror image thereof.

From the foregoing, it can be seen that each of the standard pivot pins 48S permits the slat body 42 in which the pivot pin is mounted to pivot about the slat body's axis of rotation 43. As noted above, the rotation of the slat body is initiated by movement of the connecting elements 62, the movement of which in turn is ultimately initiated by the rotation of the drive pin 48A by the drive mechanism 66.

In summary, the pivot pins include a number of the standard pivot pins 48S for rotatably supporting selected ones of the slat bodies 42. Each standard pivot pin 48S extends between inner and outer ends thereof 50S, 52S. The inner end 50S of each standard pivot pin 48S is secured in an end of one of the selected ones of the slat bodies 42. The outer end 52S of each standard pivot pin 48S is rotatably located in the bushing 78 held in a selected one of the side members 3A, 32B.

Figure 1D:
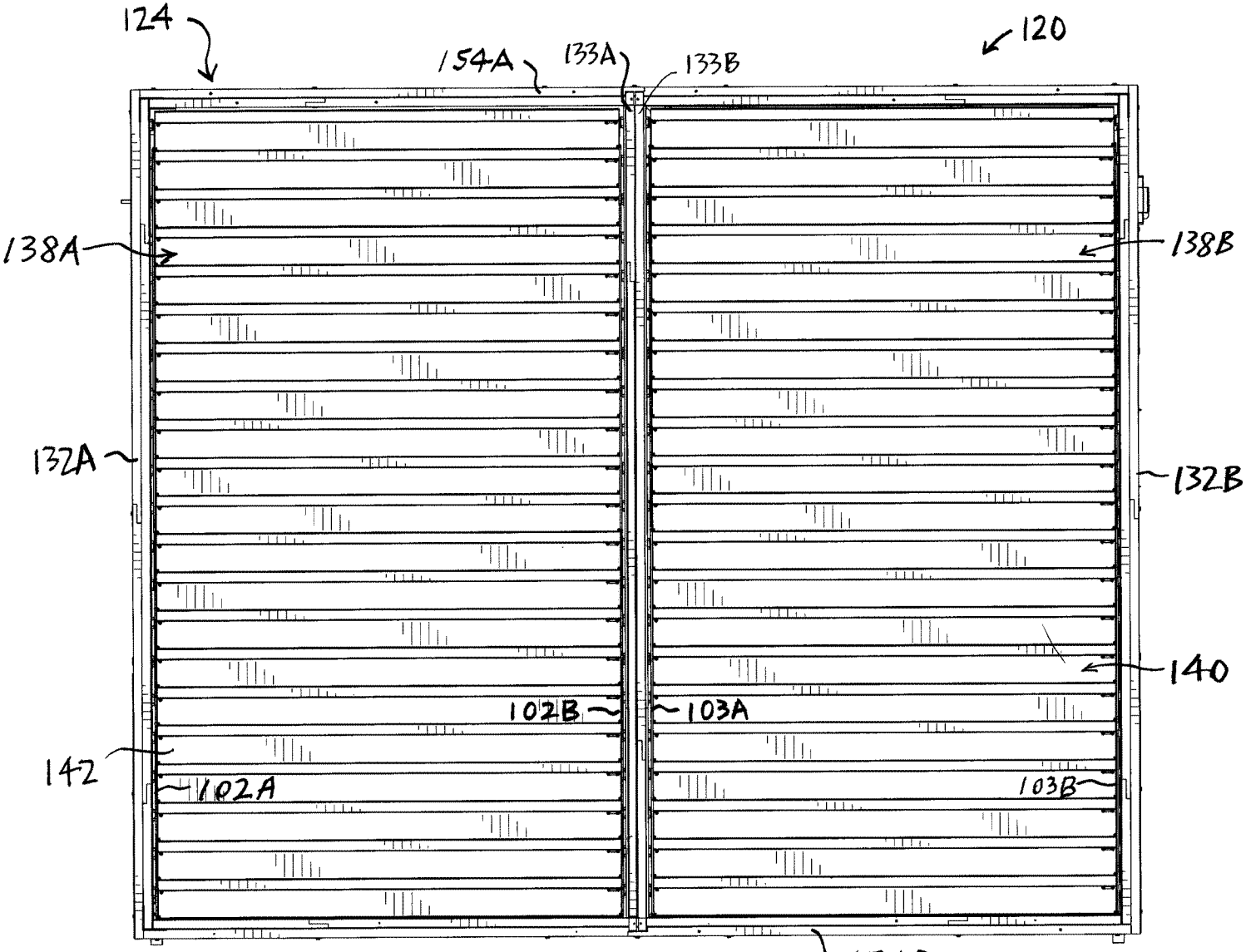
FIG. 1D is a top view of an alternative embodiment of the system of FIGS. 1A and 1B in which the louver assembly is in a closed condition, drawn at a smaller scale.
Figure 1E:
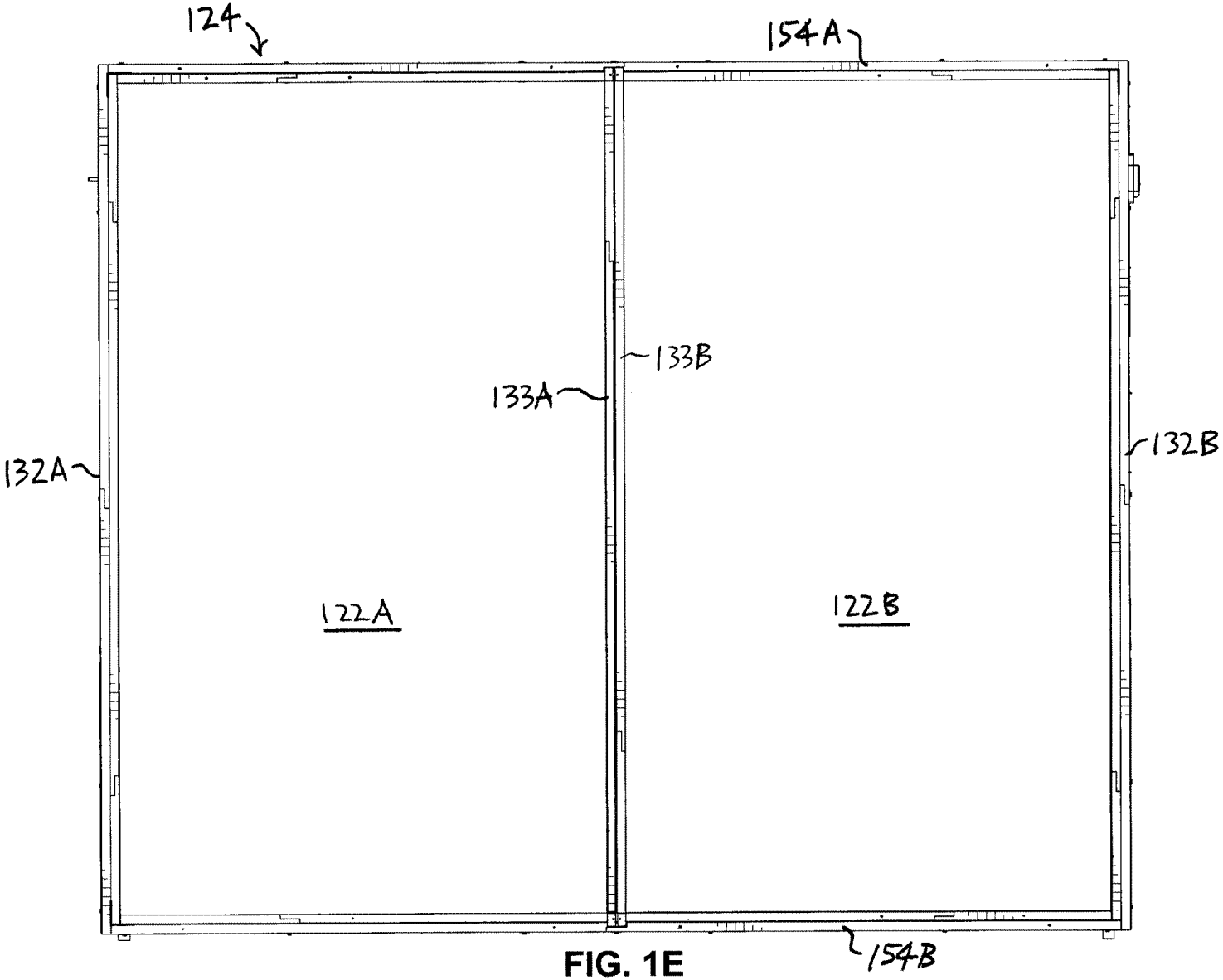
FIG. 1E is a top view of the frame assembly of FIG. 1D.

As can be seen in FIGS. 1D and 1E, in an alternative embodiment, the system 120 preferably includes a frame assembly 128 that includes a frame 124 defining two apertures 122A, 122B. It is preferred that the frame 124 includes side elements 132A, 132B and end elements 154A, 154B. The frame 124 preferably also includes central elements 133A, 133B that extend between the end elements 154A, 154B to define the apertures 122A, 122B (FIG. 1E). The central elements 133A, 133B preferably are located adjacent to each other, as can be seen in FIGS. 1E and 7.

As can be seen in FIG. 1D, the system 120 preferably includes two louver assemblies 138A, 138B. The louver assemblies 138A, 138B are mounted in the frame 124 to cover the apertures 122A, 122B respectively, when the slat subassemblies therein are in the closed position.

Figure 7:
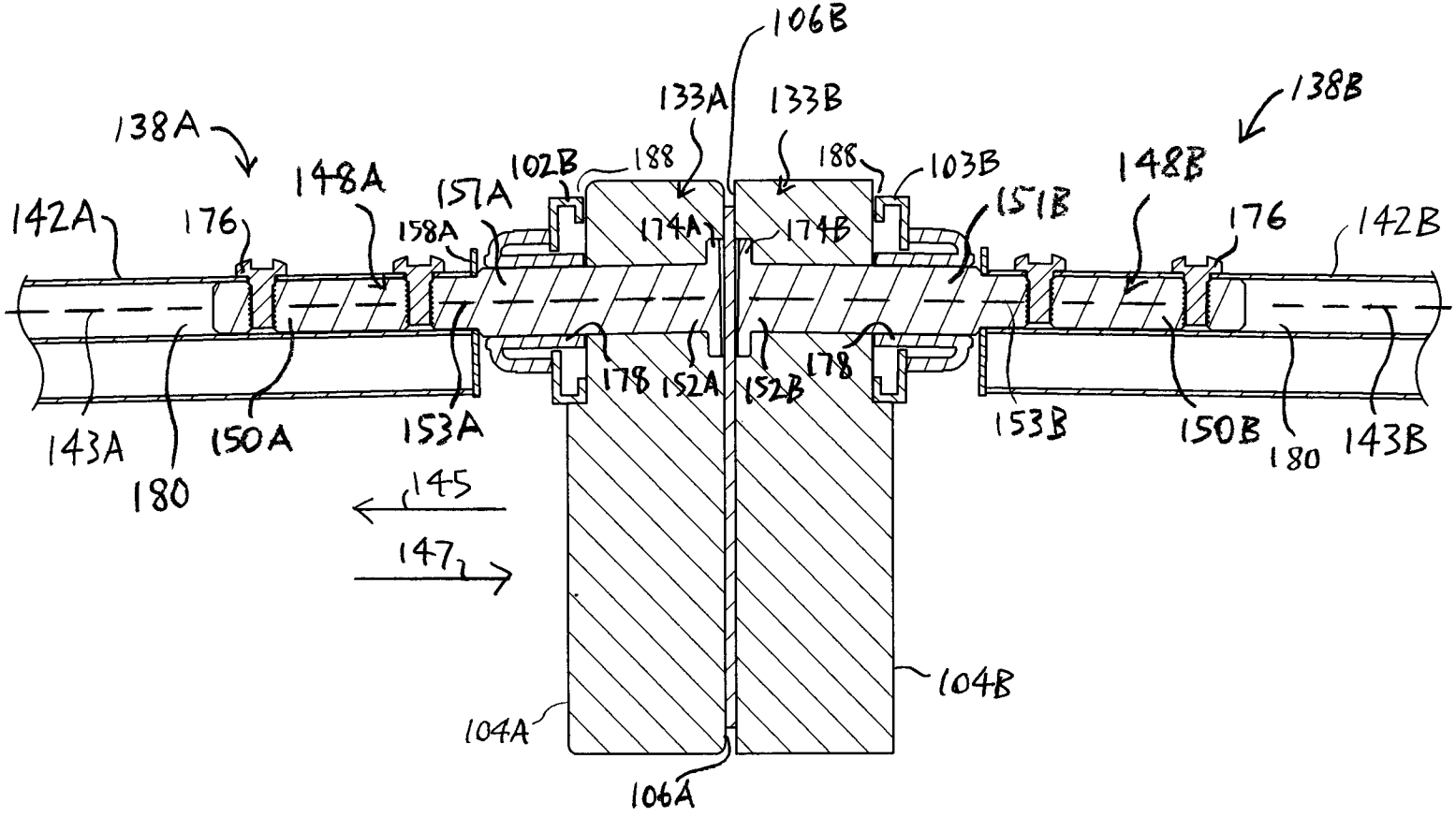
FIG. 7 is a cross-section showing the intermediate pivot pins of FIG. 6 mounted in central elements of the alternative frame assembly of FIGS. 1D and 1E, drawn at a smaller scale.

The louver assembly 138A preferably includes side members 102A, 102B, and the louver assembly 138B preferably includes side members 103A, 103B (FIGS. 1D, 7). The side members 102A, 103A preferably are mounted to the side elements 132A, 132B respectively. It will be understood that the louver assemblies 138A, 138B are secured to the side elements 132A, 132B in the same manner as the louver assembly 38 is secured to the side elements 32A, 32B, as described above. The side members 102A, 103B are mounted to the side elements 132A, 132B.

As can be seen in FIG. 7, the central element 133A preferably extends between an inner side 104A, proximal to the slat bodies 142A of the louver assembly 138A, and an outer side 106A which is distal to the slat bodies 142A. Similarly, the central element 133B preferably extends between inner and outer sides 104B, 106B. A layer 105 of suitable material may be located between the central elements 133A, 133B.

The other side members 102B, 103B preferably are mounted to the central elements 133A, 133B respectively. As can be seen in FIG. 7, the side member 102B preferably is positioned in a slot 188 formed in the inner side 104B of the central element 133A. Similarly, the side member 103B preferably is positioned in the slot 188 that is formed in the inner side 1-4B of the central element 133B. It is also preferred that bushings 178 are located in each of the side members 102B, 103B (FIG. 7).

As can be seen in FIG. 7, the louver assemblies 138A, 138B preferably are secured to the central elements 133A, 133B respectively by intermediate pivot pins 148. It will be understood that the louver assemblies 138A, 138B are secured to the respective side elements 132A, 132B by the extended pivot pins 48E (not shown in FIG. 7), as described above. It will also be understood that each of the slat bodies 142 in each of the louver assemblies 138A, 138B is rotatable about its respective axis of rotation, such rotation being initiated by a drive mechanism (not shown) suitably connected with each louver assembly 138A, 138B respectively, i.e., via a drive pivot pin in each case (not shown). Similarly, the louver assemblies 138A, 138B preferably also include a number of standard pivot pins 48S (not shown), to facilitate rotation of the slat bodies 142 about their respective axes of rotation. As described above, such rotation is ultimately initiated by drive mechanisms (not shown) for each of the louver assemblies respectively.

Figure 6:
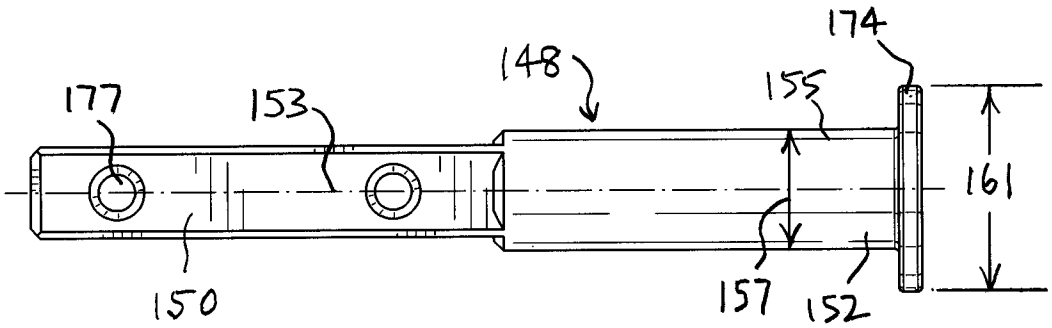
FIG. 6 is a plan view of an embodiment of an intermediate pivot pin of the invention, drawn at a larger scale.

As can be seen in FIG. 6, in one embodiment, the intermediate pivot pin 148 preferably includes an inner end 150, and an outer end 152. It is preferred that the inner end 150 is square in cross-section, and the outer end 152 is round. Preferably, the inner end 150 includes holes 177 in which fasteners 176 are receivable. The slat bodies 142A, 142B preferably each include channels 180 that are square in cross-section, and the inner end 150 is formed to be received in the channel 180 (FIG. 7). The inner end 150 is secured in the channel 180 in the slat body 142 by the fasteners 176 (FIG. 7). The intermediate pivot pin 148 is defined by its axis of rotation 153.

It is also preferred that the outer end 152 includes a head portion 174. An outer end segment 155, proximal to the head portion 174, has an outer end segment diameter 157. The head portion 174 has a head portion diameter 161 that is larger than the outer end segment diameter 157 (FIG. 6).

In FIG. 7, the intermediate pivot pins included in the louver assemblies 138A, 138B are identified by reference characters 148A and 148B respectively for convenience. As can be seen in FIG. 7, the head portion 174A preferably is embedded in the outer side 106A of the central element 133A. Similarly, the head portion 174B preferably is embedded in the outer side 106B of the central element 133B.

In one embodiment, the head 174A of the intermediate pivot pin 148A preferably is countersunk in the outer side 106A of the central element 133A, and the head 174B of the intermediate pivot pin 148B preferably is countersunk in the outer side 1068 of the central element 133B.

The intermediate pivot pins 148A, 148B preferably each include intermediate segments 151A, 151B that are respectively located between the inner ends 150A, 150B and the outer ends 152A, 152B.

The intermediate segment 151A is at least partially located in a bushing 178 in the side member 102B. Similarly, the intermediate segment 151B is at least partially located in the bushing 178 in the side member 103B. The bushings 178 are mounted in side elements 102B, 103B (FIG. 7). The side elements 102B, 103B are respectively mounted in slots 188 on the inner sides 104A, 104B of the central elements 133A, 133B.

The intermediate pivot pins 148A, 148B are for partially supporting the respective louver assemblies 138A, 138B, and for holding the respective louver assemblies 138A, 138B in position, covering the respective apertures 122A, 122B. As can be seen in FIG. 7, movement of the louver assembly 138A to the left (i.e., in the direction indicated by arrow 145) is prevented by the head 174A. Movement of the louver assembly 138A in the opposite direction (i.e., in the direction indicated by arrow 147) is stopped when the end plate 158A engages the bushing 178. As can be seen in FIG. 7, the intermediate pivot pin 148B is the mirror image of the intermediate pivot pin 148A, so further description of the intermediate pivot pin 148B is unnecessary.

The intermediate pivot pin 148A (with an axis of rotation 153A) is located coaxial with the axis of rotation 143A of the slat body 142A, and the intermediate pivot pin 148B (with an axis of rotation 153B) is located coaxial with the axis of rotation 143B of the slat body 142B. The inner ends 150A, 150B of the intermediate pivot pins 148A, 148B are secured in the channels 180 in the slat bodies 142A, 142B respectively by fasteners 176.

Figure 8A:
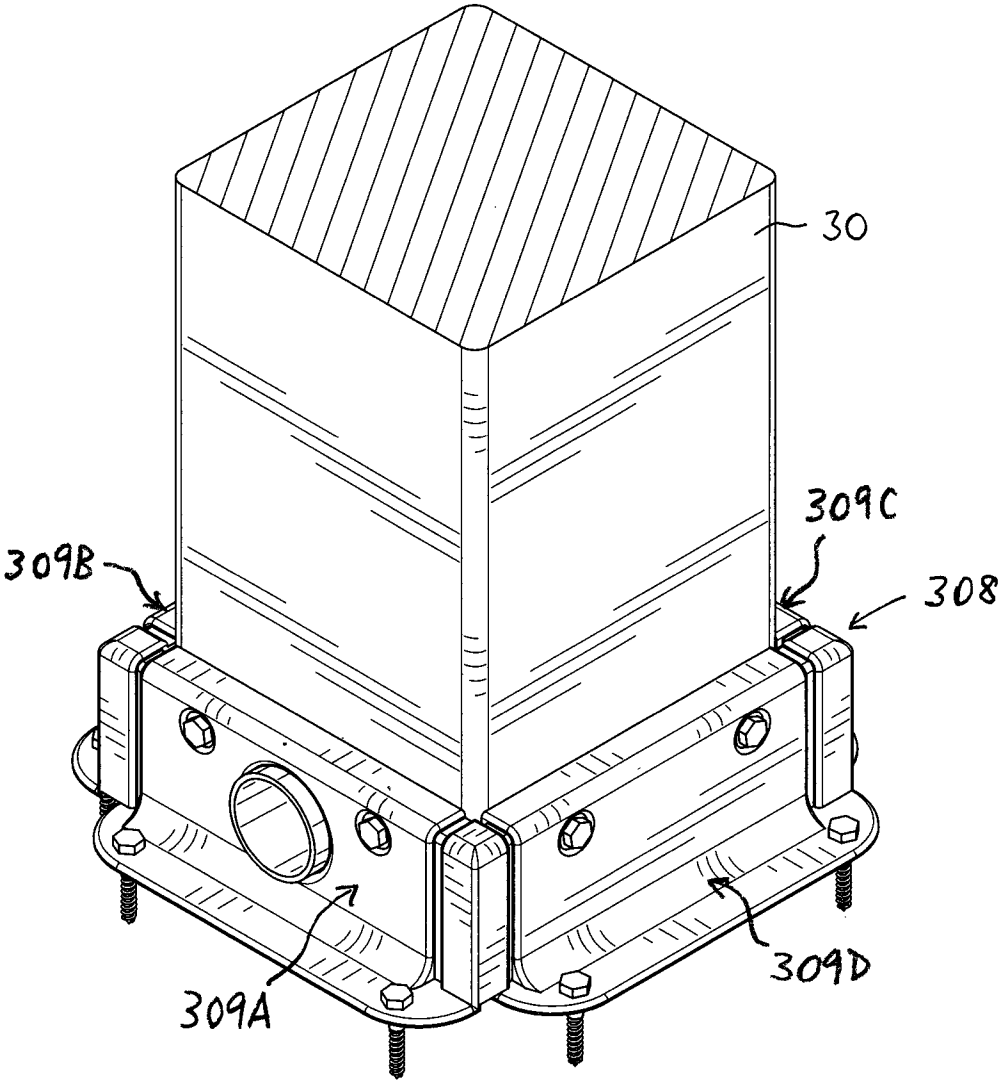
FIG. 8A is an isometric view of an embodiment of a post bracket assembly of the invention in a first configuration thereof with a part of a first post located therein, drawn at a smaller scale.
Figure 8B:
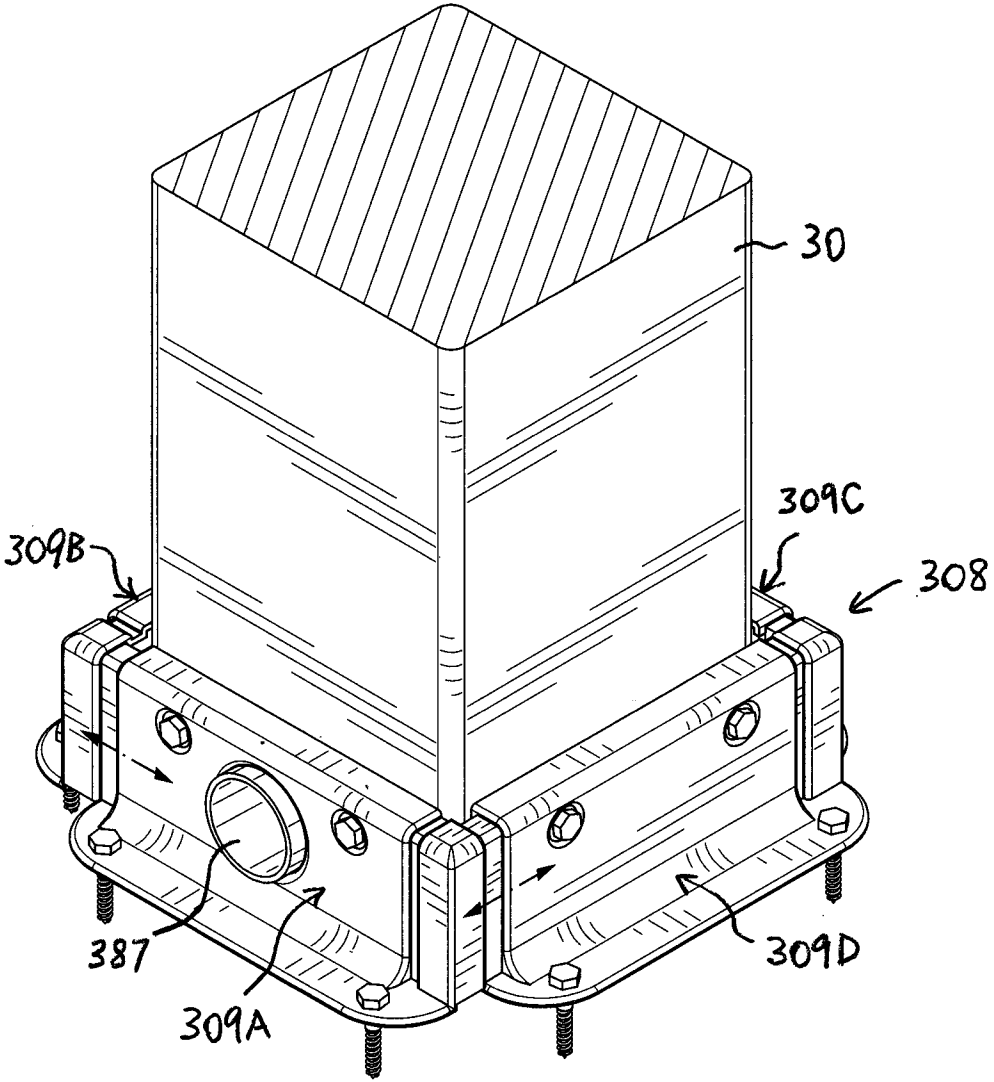
FIG. 8B is an isometric view of the post bracket assembly of FIG. 8A in a second configuration thereof, with a part of a second post located therein.

As can be seen in FIGS. 8A and 8B, in one embodiment, a post bracket assembly 308 is for securing the post 30 to the surface 26. It is preferred that the post bracket assembly 308 can be adjusted to fit posts of different sizes.

Figure 8C:
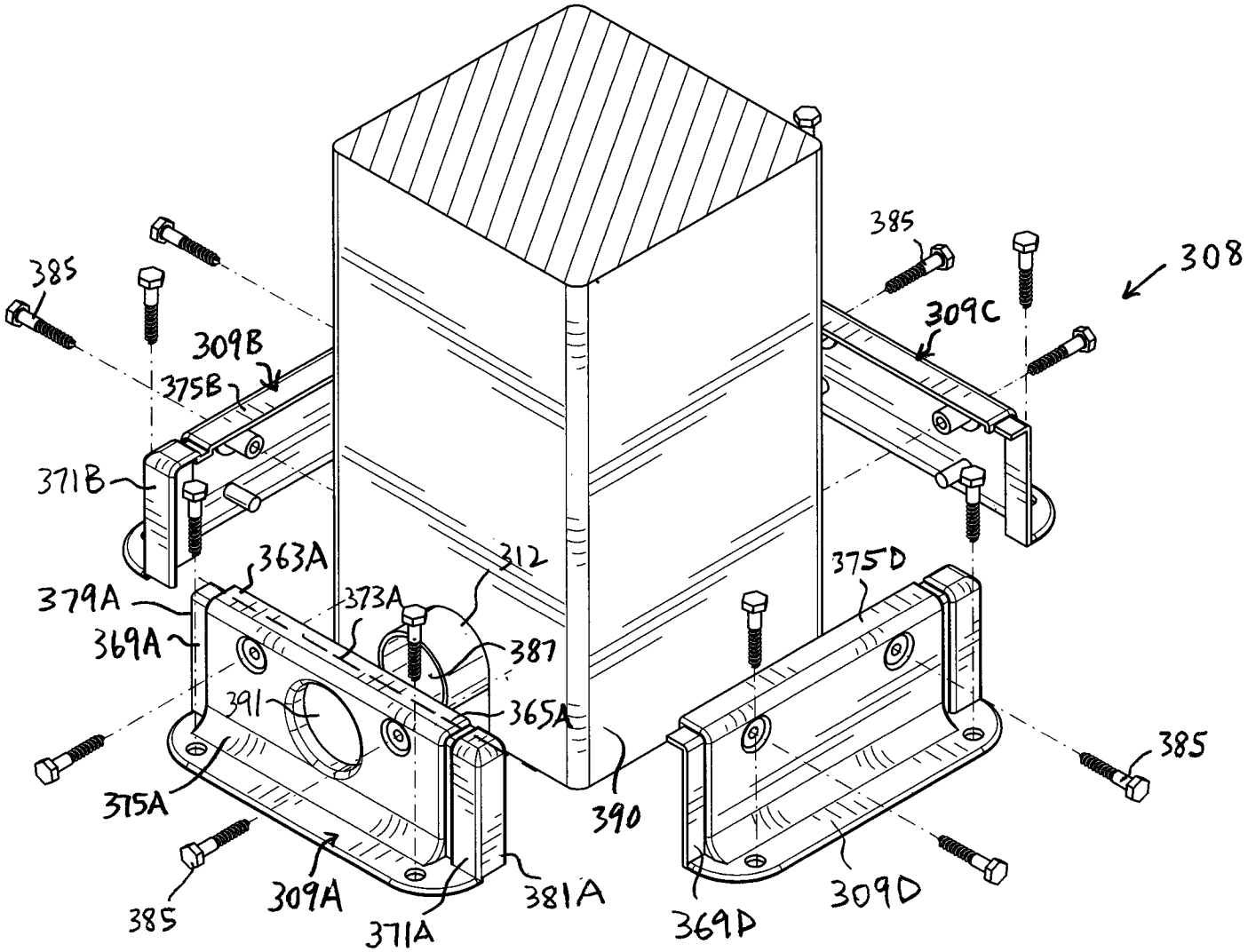
FIG. 8C is an isometric exploded view of the post bracket assembly of FIGS. 8A and 8B.

As illustrated in FIGS. 8A-8C, the post bracket assembly 308 preferably includes four portions 309A-309D that are formed to cooperate with each other to surround the post 30, and to secure the post 30 to the surface 26. Preferably, the post bracket assembly 308 also includes a number of fasteners 385, for fastening the portions 309A-309D to the support element 30 and to the surface 26. For example, the portion 309A includes a body 375A having a first end 363A and a second end 365A. At the first end 363A, a movable insert element 369A is located, and at the second end 365A, a movable receiving element 371A is located. Each of the movable insert element 369A and the movable receiving element 371A is movable along an axis 373A of the portion 309A, in a telescoping fashion from the body 375A, to extend ends 379A, 381A thereof away from the first and second ends 363A, 365A respectively.

As can be seen in FIG. 8C, in order to fit the post bracket assembly 308 around the post 30, a user (not shown) moves the movable insert element 369A and the movable receiving element 371A relative to the body 375A, and also a movable receiving element 371B is moved relative to the body 375B and the movable insert element 369D is moved relative to the body 375D, so that the movable insert element 369A is received in the movable receiving element 371B, and also so that the movable insert element 369D is received in the movable receiving element 371A. Preferably, the extent to which the movable insert element and the movable receiving element is extended outwardly along the axis of each portion is approximately the same. The assembled post bracket assembly 308 in which this is achieved can be seen in FIG. 8B. It will be understood that, once the portions 309A-309D are suitably arranged around the post 30 and on the surface 26, the portions 309A-309D are secured to the post 30 and to the surface 26 by the fasteners 385.

As can be seen in FIG. 8A, the post bracket assembly 308 may be used to secure the post 30 to the surface 26 without extending the movable insert elements and the movable receiving elements.

As shown in FIG. 8C, in one embodiment, a drain 312 is located in the post 30. An output opening 387 of the drain 312 may be located at a bottom end 390 of the post 30. In order to accommodate the output opening, the body 375A may include an aperture 391 (FIG. 8C).

Figure 9B:
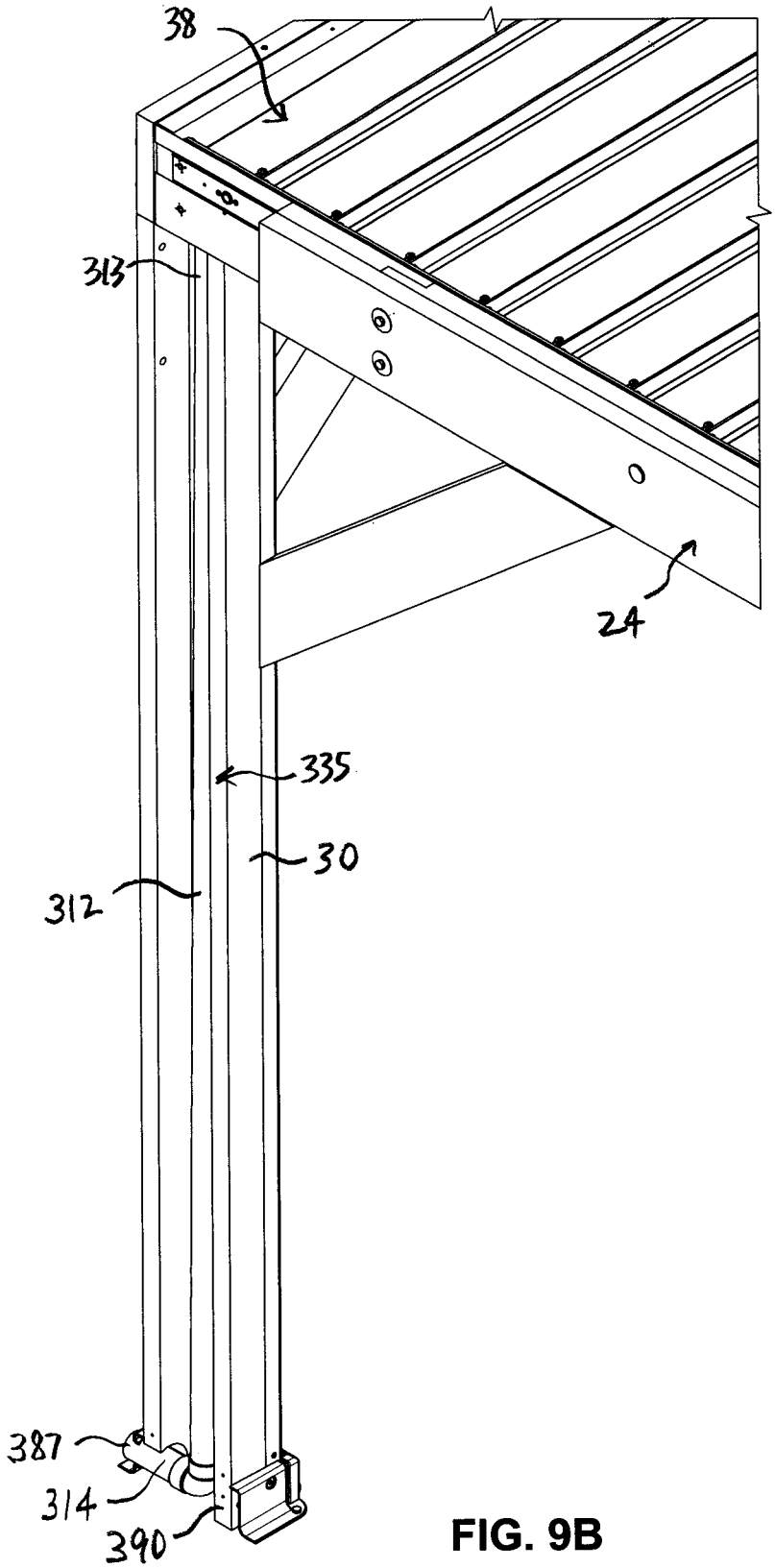
FIG. 9B is an isometric view of a portion of the frame assembly of FIG. 1A including an embodiment of a drain element of the invention located inside a post of the frame assembly, drawn at a smaller scale.

In one embodiment, the frame assembly 28 preferably includes the drain 312 (FIG. 9B). Preferably, the drain 312 extends between upper and lower ends 313, 314 thereof, and is configured to direct water away from the post 30, at the lower end 390 of the post 30.

It will be understood that the systems 20, 120 preferably include a drainage assembly 335 that includes one or more gutters 392 (FIG. 9A) that are formed and positioned to collected precipitation that falls on the slat bodies, when they are in the closed positions thereof. Preferably, the gutter 392 is mounted to the side elements 32A, 32B, below the side members 56A, 56B, and positioned to receive precipitation (not shown) that falls onto the slat bodies. The precipitation preferably is directed by the slat bodies to fall into the gutter 392. The gutter 392 is also preferably mounted to the frame 24 so that it is sloped, so that the precipitation collected therein runs along the gutter 392 and is directed to the upper ends 313 of one or more drains 312 that are located in one or more of the posts or support elements 30. As an example, the direction of the flow of the precipitation collected in the gutter 392 is indicated by arrow "K" in FIG. 9A. It will be understood that the drain 312 and the post 30 are omitted from FIG. 9A for clarity of illustration. The gutter 392 and the drain 312 are included in the drainage assembly 335.

It will also be understood that the location of the gutter 392 on the side element 32A is the mirror image of that shown in FIG. 9A.

In summary, the louver system preferably includes the drainage assembly 335. The drainage assembly 335 preferably includes the gutter 392, located on the inner sides of one or both of the first and second side elements 32A, 32B. The gutter 392 is positioned to receive water that runs off the slat bodies 42, when the slat bodies 42 are in the closed positions thereof. The drainage assembly 335 also includes the drain 312, located to drain the gutter 392, and to direct the water collected in the gutter 392 away from the frame assembly 28.

It is preferred that the drain 312 is located at least partially in a selected one of the support elements 30.

As can be seen in FIG. 3C, in one embodiment, the slat body 42 preferably includes a box portion 515 and a trough portion 516. The box portion 515 may define a first channel 80 and a second channel 517. The first and second channels 80, 517 are spaced apart from a back wall 518 of the box portion 515 by a planar region 519 of the box portion 515. An open region "Q" is defined in the box portion 515, between the back wall 518 and the first and second channels 80, 517 (FIG. 3C). The box portion 515 also includes an inner trough wall 521. As can be seen in FIG. 3C, the trough 516 is located between the inner trough wall 521 and an outer trough wall 523. The outer trough wall 523 ends in an outer wall edge 525.

Figure 3D:
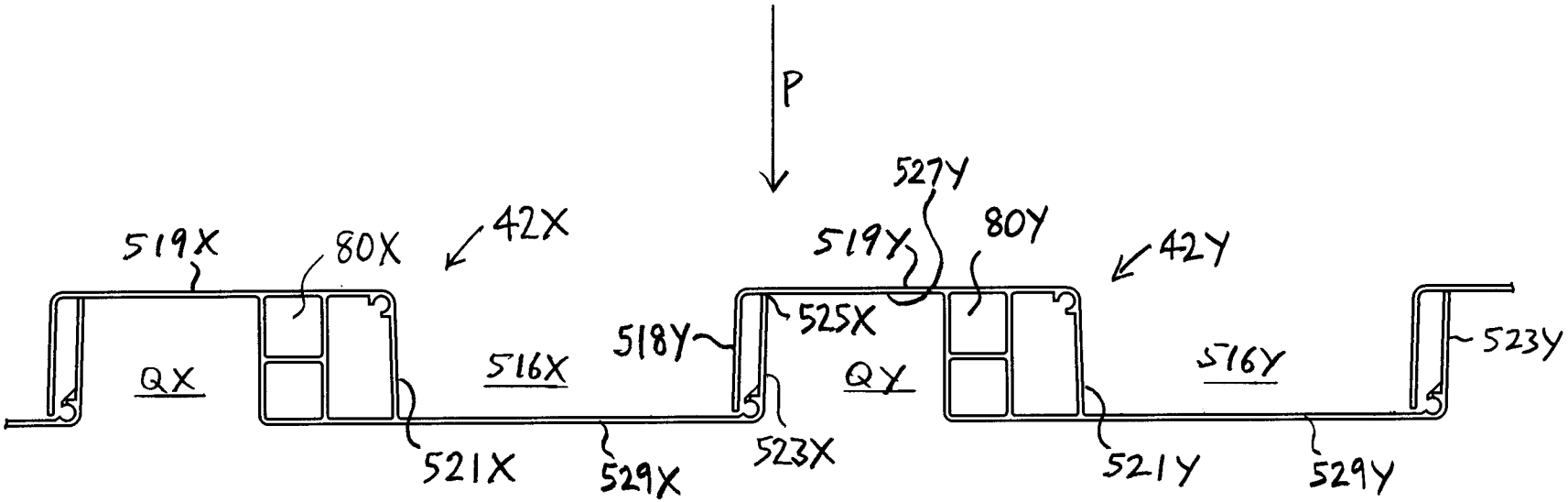
FIG. 3D is a cross-section of two slat bodies, when the slat bodies are located in closed positions, drawn at a smaller scale.
Figure 3E:
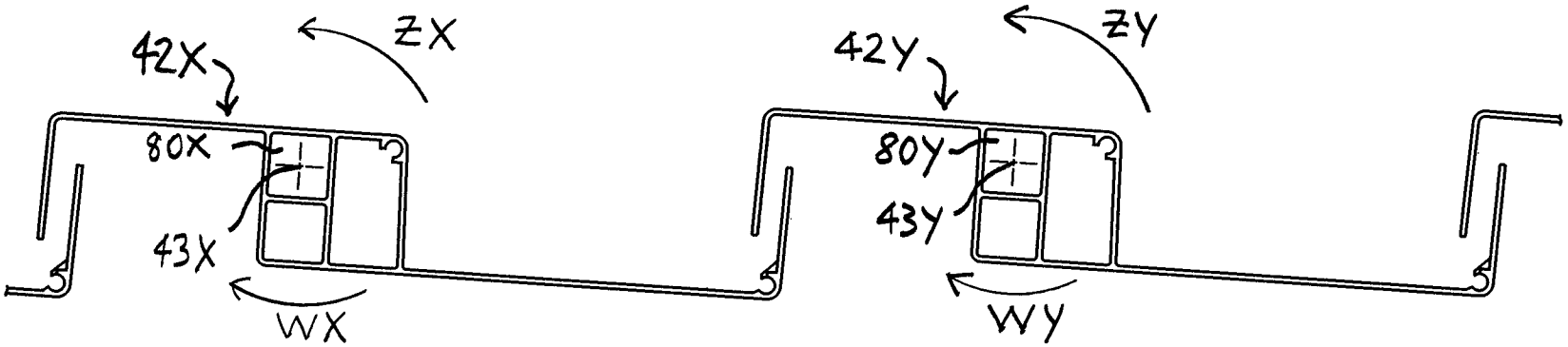
FIG. 3E is a cross-section showing the two slat bodies of FIG. 3D in intermediate positions thereof.
Figure 4C:
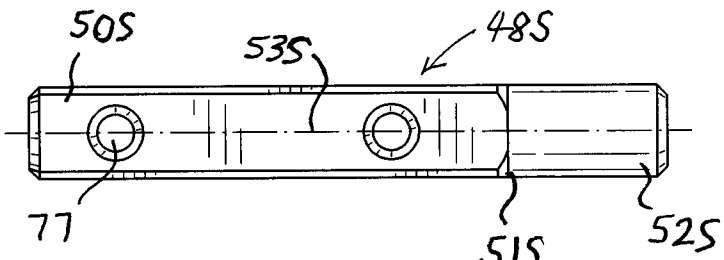
FIG. 4C is a plan view of the standard pivot pin of FIG. 2D.

The slat bodies 42 are formed to cooperate with each other, when they are in the closed positions thereof, to substantially prevent precipitation falling through the aperture 22. As can be seen in FIG. 3D, when the slat bodies 42 are in the closed positions, the slat bodies interlock with each other. Two slat bodies positioned proximal to each other, identified in FIG. 3D for convenience by reference characters 42X and 42Y, are shown in their closed positions in FIG. 3D. In FIG. 3E, the slat bodies 42X, 42Y are also shown in intermediate positions (i.e., between the closed and open positions thereof). The slat bodies 42X, 42Y include respective channels 80X, 80Y defined therein. Planar regions 519X, 519Y partially define respective open regions "QX", "QY".

A trough 516X in the slat body 42X is partially defined by an inner trough wall 521X, an outer trough wall 523X, and a trough floor 529X, and a trough 516Y in the slat body 42Y is partially defined by an inner trough wall 521Y, an outer trough wall 523Y, and a trough floor 529Y.

In one embodiment, when the slat bodies 42X, 42Y are in their closed positions (FIG. 3D), the outer trough wall 523X of the slat body 42X preferably is located in the open region "QY" of the slat body 42Y. As shown in FIG. 3D, the outer wall edge 525X may engage an internal side 527Y of the planar region 519Y of the slat body 42Y. At the same time, the back wall 518Y of the slat body 42Y is located in the trough 516X of the slat body 42X. It will be understood that precipitation (schematically represented by arrow "P" in FIG. 3D) is partially collected in the troughs 516X, 516Y. The precipitation collected in the troughs 516X, 516Y preferably is directed toward the gutters (not shown), which are mounted to the side elements of the frame 24.

As noted above, the slat bodies are rotatable about axes of rotation. It will be understood that, as described above, all of the slat bodies in the louver assembly 38 rotate together, in unison, or substantially in unison. Only two slat bodies are shown in FIGS. 3D and 3E for clarity of illustration.

The slat bodies 42X, 42Y are shown in intermediate positions thereof in FIG. 3E, i.e., between the closed and open positions of the slat bodies. The slat bodies 42X, 42Y arrive at these intermediate positions due to rotation thereof about the respective axes of rotation 43X, 43Y, which are centered in the respective channels 80X, 80Y.

For example, movement of the slat bodies 42X, 42Y from the closed positions to the intermediate positions is schematically represented by arrows "WX", "WY" respectively (FIG. 3E). Similarly, movement of the slat bodies 42X, 42Y from the open positions thereof to the intermediate positions is schematically represented by arrows "ZX", "ZY" respectively.

The slat bodies are formed so that they may be nested together, for shipping. When two of the slat bodies are nested together, they occupy a minimum volume.

Figure 10A:
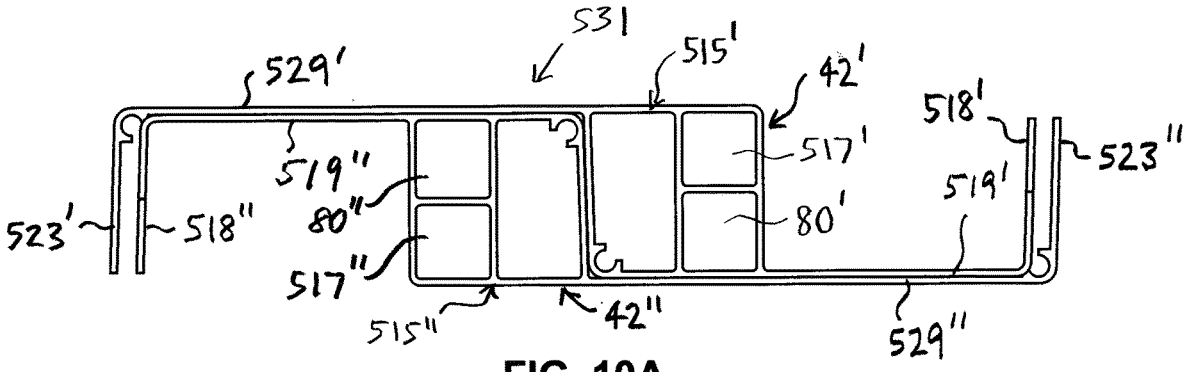
FIG. 10A is an end view of a nested pair of the slat bodies, drawn at a larger scale.

For example, in FIG. 10A, a first slat body 42' is nested with a second slat body 42". As illustrated in FIG. 10A, to nest the two bodies, the first slat body 42' preferably is inverted relative to the second slat body 42". For clarity of illustration, two nested slat bodies are hereinafter generally identified by reference character 531.

A box portion 515' of the first slat body 42' (including the first and second channels 80', 517' therein) is located, inverted, in the trough portion 516" of the second slat body 42". The planar region 519' of the first slat body 42' engages the trough floor 529" of the second slat body 42". As can be seen in FIG. 10A, the back wall 518' of the first slat body 42' is positioned proximal to the outer trough wall 523" of the second slat body 42".

A box portion 515" of the second slat body 42" (including the first and second channels 80", 517" therein) is located in the trough portion 516' of the first slat body 42'. The planar region 519" of the second slat body 42" engages the trough floor 529 of the first slat body 42'. As can be seen in FIG. 10A, the back wall 518" of the second slat body 42" is positioned proximal to the outer trough wall 523' of the first slat body 42'. In summary, a pair of the slat bodies are formed to nest together in a configuration in which one of the slat bodies is inverted, to fit with the other of the slat bodies, to form the nested pair of slat bodies 531.

Figure 10B:
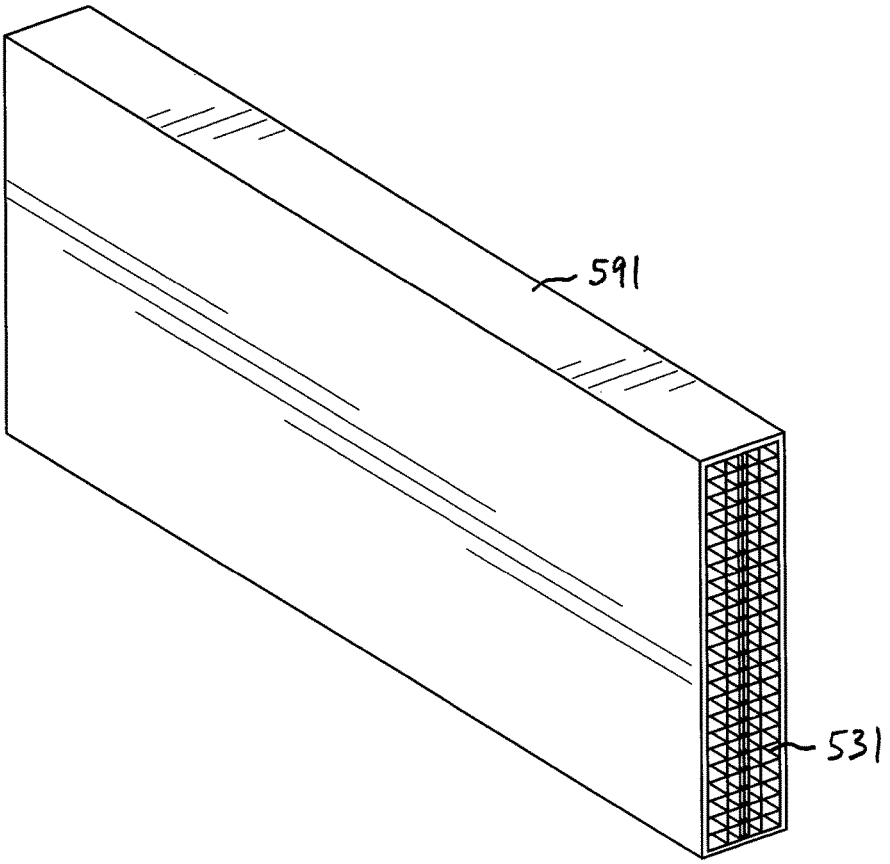
FIG. 10B is an isometric view of a container in which a number of nested pairs of the slat bodies are located, drawn at a smaller scale.

From the foregoing, it can be seen that the slat bodies may be nested, so that each nested pair of slat bodies 531 occupies a relatively small volume. In FIG. 10B, a large number of nested slat bodies are shown located inside a container or box 591. As can be seen in FIG. 10B, a relatively large number of pairs of nested slat bodies 531 may fit inside a relatively small container 591. Those skilled in the art would appreciate that minimizing the volume occupied by the slat bodies results in lower shipping costs.

Figure 10C:
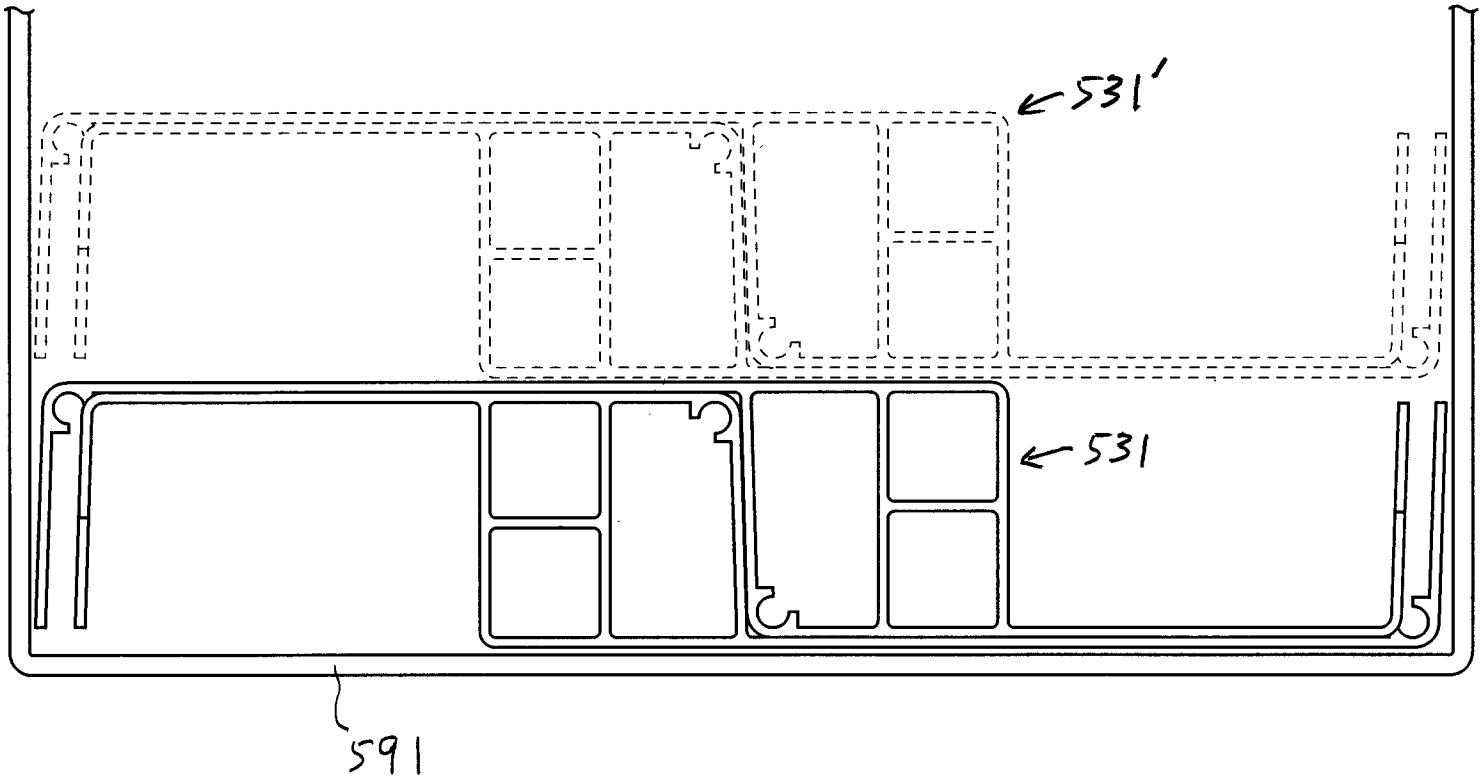
FIG. 10C is an end view of nested pairs of the slat bodies in the container, drawn at a larger scale.

As can be seen in FIG. 10C, it is preferred that the nested pairs of the slat bodies 531 are stacked on top of each other in the container 591, which is formed to receive the nested pairs of the slat bodies 531. For clarity of illustration, in FIG. 10C, the nested pair of the slat bodies 531' positioned on top of the lowermost pair 531 is drawn in dashed lines. It will be understood that other nested pairs of the slat bodies are stacked on top of the pairs 531, 531' until the container 591 is filled, as shown in FIG. 10B.

It will be appreciated by those skilled in the art that the invention can take many forms, and that such forms are within the scope of the invention as claimed. The scope of the claims should not be limited by the preferred embodiments set forth in the examples, but should be given the broadest interpretation consistent with the description as a whole.

I claim:

1. A louver system comprising:

a frame assembly comprising:

a frame comprising first and second side elements having opposed inner and outer sides thereof, the first and second side elements being spaced apart from each other so that the inner sides thereof partially define an aperture therebetween;

at least one support element supporting the frame in a preselected position relative to a surface;

at least one louver assembly mounted to the frame, said at least one louver assembly extending between respective first and second side members thereof located parallel to the first and second side elements respectively, said at least one louver assembly comprising a plurality of slat subassemblies comprising respective slat bodies pivotable about respective axes of rotation thereof between respective closed positions thereof, in which the slat bodies cooperate with each other to collectively cover the aperture and said at least one louver assembly is in a closed condition, and respective open positions thereof, in which the aperture is at least partially uncovered and said at least one louver assembly is in an open condition, each said slat body extending between first and second ends thereof located proximal to the first and second side members of said at least one louver assembly respectively;

a plurality of pivot pins, each said pivot pin extending between an inner end thereof mounted in a selected one of the first and second ends of a selected one of the slat bodies, each said pivot pin being partially defined by a pivot pin axis thereof, and an outer end thereof, extending beyond the selected one of the first and second ends of the selected one of the slat bodies, and each said pivot pin comprising an intermediate segment thereof, between the inner and outer ends thereof;

the pivot pins comprising at least one extended pivot pin, the outer end of said at least one extended pivot pin being formed to be partially positioned in a selected one of the first and second side elements and to engage the outer side of the selected one of the first and second side elements; and the inner end of said at least one extended pivot pin being formed to be located in a selected one of the slat bodies, said at least one extended pivot pin being configured to at least partially rotatably secure the selected one of the slat bodies between the first and second side elements, to partially locate said at least one louver assembly in said at least one aperture.

2. A louver system according to claim 1 in which each said pivot pin is located coaxially with the slat body in which the inner end of each said pivot pin is secured.

3. A louver system accordingly to claim 1 in which:

(a) the outer end of said at least one extended pivot pin comprises an outer end body having an outer end body diameter; and (b) the outer end of said at least one extended pivot pin comprises a head portion having a head portion diameter greater than the outer end body diameter, wherein the head portion is formed to engage the outer side of the selected one of the first and second side elements.

4. A louver system according to claim 3 additionally comprising a first extended pivot pin and a second extended pivot pin, and in which the first and second extended pivot pins are partially located in the first and second side elements respectively, wherein the head portions of the first and second extended pivot pins engage the outer sides of the first and second side elements respectively and the inner ends of the first and second extended pivot pins are respectively secured in first and second ends of the selected one of the slat bodies to rotatably secure the selected one of the slat bodies between the first and second side elements respectively, to at least partially secure the louver assembly between the first and second side elements.

5. A louver system according to claim 1 in which the intermediate segments of the pivot pins are at least partially positioned in said first and second side members, to permit rotation of the pivot pins about their respective axes.

6. A louver system according to claim 5 in which each said slat subassembly includes end plates positioned at the respective first and second ends of each said slat body.

7. A louver system according to claim 6 in which said at least one louver assembly additionally comprises first and second elongate connecting arms respectively pivotally connecting with the end plates at the first and second ends of the slat bodies, for rotation of the slat bodies in unison about their respective axes of rotation upon movement of the connecting element along the length thereof, said first and second connecting arms being located along the first and second sides of said at least one louver assembly respectively.

8. A louver system according to claim 7 in which the pivot pins comprise at least one drive pin, the inner end of said at least one drive pin being located in a selected one of the first and second ends of a drive slat body, said drive slat body being selected from the plurality of the slat bodies, the outer end of said at least one drive pin being engageable by a drive mechanism, wherein said at least one drive pin is rotatable about the pivot pin axis thereof by the drive mechanism, and rotation of said at least one drive pin about the pivot pin axis thereof causes corresponding rotation of the drive slat body about the axis of rotation of the drive slat body.

9. A louver system according to claim 8 in which the pivot pins comprise a plurality of standard pivot pins for rotatably supporting selected ones of the slat bodies, each said standard pivot pin extending between inner and outer ends thereof, the inner end of each said standard pivot pin being secured in an end of one of the selected ones of the slat bodies, and the outer end of each said standard pivot pin being rotatably located in a bushing held in a selected one of the side members.

10. A louver system according to claim 9 additionally comprising a drainage assembly, the drainage assembly comprising:

(a) a gutter located on the inner sides of at least one of the first and second side elements, the gutter being positioned to receive water that runs off the slat bodies, when the slat bodies are all in the closed positions thereof;

(b) a drain, located to drain the gutter, and to direct the water collected in the gutter away from the frame assembly.

11. A louver system according to claim 10 in which the drain is located at least partially in a selected one of the support elements.

12. A louver system according to claim 9 in which the frame additionally comprises first end and second end elements, the first end element connecting the first and second side elements at respective first ends thereof, and the second end element connecting the first and second side elements at respective second ends thereof, wherein the first and second end elements at least partially define the aperture.

13. A louver system according to claim 9 additionally comprising a post bracket assembly for securing said at least one support element to the surface, the post bracket assembly comprising:

(a) a plurality of portions, the portions being formed to cooperate with each other to surround the post and to secure the post to the surface; and (b) a plurality of fasteners, for fastening said portions to said at least one support element and to the surface.

14. A louver system according to claim 9 in which a pair of the slat bodies are formed to nest together in a configuration in which one of the slat bodies is inverted, to fit with the other of the slat bodies.

* * * * *